US008356490B2

(12) United States Patent
Yoshimi et al.

(10) Patent No.: US 8,356,490 B2
(45) Date of Patent: Jan. 22, 2013

(54) REFRIGERATION APPARATUS

(75) Inventors: Atsushi Yoshimi, Sakai (JP); Shuji Fujimoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 391 days.

(21) Appl. No.: 12/744,262

(22) PCT Filed: Nov. 26, 2008

(86) PCT No.: PCT/JP2008/071361

§ 371 (c)(1),
(2), (4) Date: May 21, 2010

(87) PCT Pub. No.: WO2009/069603

PCT Pub. Date: Jun. 4, 2009

(65) Prior Publication Data

US 2010/0251741 A1 Oct. 7, 2010

(30) Foreign Application Priority Data

Nov. 30, 2007 (JP) ..... 2007-311492

(51) Int. Cl.
*F25B 13/00* (2006.01)

(52) U.S. Cl. ..... 62/324.5; 62/510

(58) Field of Classification Search ..... 62/510, 62/513, 498, 324.5, 151, 234; 417/243, 244, 417/245

See application file for complete search history.

(56) References Cited

U.S. PATENT DOCUMENTS 3,680,973 A * 8/1972 Pilarczyk ..... 415/58.1
3,719,057 A * 3/1973 Grant ..... 62/193
4,660,384 A * 4/1987 Pallanch ..... 62/81
4,947,655 A * 8/1990 Shaw ..... 62/200
5,150,581 A * 9/1992 Smith ..... 62/115
5,769,610 A * 6/1998 Paul et al. ..... 417/228
7,028,491 B2 * 4/2006 Horton ..... 62/158
7,096,679 B2 * 8/2006 Manole ..... 62/115
7,131,294 B2 * 11/2006 Manole ..... 62/513
7,331,196 B2 * 2/2008 Itsuki et al. ..... 62/510

(Continued)

FOREIGN PATENT DOCUMENTS

JP 56-42067 A 4/1981

(Continued)

OTHER PUBLICATIONS

International Preliminary Report of corresponding PCT Application No. PCT/JP2008/071361.

(Continued)

*Primary Examiner* — Mohammad Ali
(74) *Attorney, Agent, or Firm* — Global IP Counselors

(57) ABSTRACT

A refrigeration apparatus uses a refrigerant that operates in a supercritical range. The refrigeration apparatus includes a compression mechanism, a heat source-side heat exchanger, an expansion mechanism, a usage-side heat exchanger, a switching mechanism, an intercooler which functions as a cooler of refrigerant discharged from a first-stage compression element of the compression mechanism and drawn into a second-stage compression element of the compression mechanism, and an intercooler bypass tube. The switching mechanism is configured to switch between cooling and heating operation states in which refrigerant is circulated differently. When a defrosting operation for defrosting the heat source-side heat exchanger is performed, refrigerant flows to the heat source-side heat exchanger and the intercooler. After defrosting of the intercooler is detected as being complete, the intercooler bypass tube is used to ensure that the refrigerant does not flow to the intercooler.

4 Claims, 17 Drawing Sheets

U.S. PATENT DOCUMENTS

| | | | | |
|---|---|---|---|---|
| 7,631,510 | B2 * | 12/2009 | Radermacher et al. | 62/196.2 |
| 7,721,569 | B2 * | 5/2010 | Manole | 62/513 |
| 2002/0014088 | A1 * | 2/2002 | Seki et al. | 62/498 |
| 2003/0177782 | A1 * | 9/2003 | Gopalnarayanan et al. | 62/505 |
| 2003/0192338 | A1 | 10/2003 | Manohar et al. | |
| 2005/0115260 | A1 * | 6/2005 | Yap | 62/238.6 |
| 2005/0132729 | A1 * | 6/2005 | Manole | 62/149 |
| 2005/0166626 | A1 | 8/2005 | Matsumoto et al. | |
| 2005/0279127 | A1 * | 12/2005 | Jia et al. | 62/510 |
| 2006/0083626 | A1 * | 4/2006 | Manole | 417/245 |
| 2006/0083627 | A1 * | 4/2006 | Manole | 417/245 |
| 2006/0086110 | A1 * | 4/2006 | Manole | 62/175 |
| 2007/0000281 | A1 * | 1/2007 | Manole | 62/513 |
| 2009/0044564 | A1 | 2/2009 | Okamoto | |
| 2009/0301109 | A1 * | 12/2009 | Manole | 62/79 |

FOREIGN PATENT DOCUMENTS

| | | | |
|---|---|---|---|
| JP | 06-028563 | U | 4/1994 |
| JP | 2004-116957 | A | 4/2004 |
| JP | 2004-177020 | A | 6/2004 |
| JP | 2005-214558 | A | 8/2005 |
| JP | 2007-057148 | A | 3/2007 |
| JP | 2007-107771 | A | 4/2007 |
| JP | 2007-154726 | A | 6/2007 |
| JP | 2007-232263 | A | 9/2007 |

OTHER PUBLICATIONS

European Search Report of corresponding EP Application No. 06 82 2402.1 dated Jan. 12, 2011.

Japanese Notice of Allowance of corresponding Japanese Application No. 2007-311492 dated Apr. 24, 2012.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2007-311492, filed in Japan on Nov. 30, 2007, the entire contents of which are hereby incorporated herein by reference.

TECHNICAL FIELD

The present invention relates to a refrigeration apparatus, and particularly relates to a refrigeration apparatus which has a refrigerant circuit configured to be capable of switching between a cooling operation and a heating operation and which performs a multistage compression refrigeration cycle by using a refrigerant that operates in a supercritical range.

BACKGROUND ART

As one conventional example of a refrigeration apparatus which has a refrigerant circuit configured to be capable of switching between a cooling operation and a heating operation and which performs a multistage compression refrigeration cycle by using a refrigerant that operates in a supercritical range, Japanese Laid-open Patent Application No. 2007-232263 discloses an air-conditioning apparatus which has a refrigerant circuit configured to be capable of switching between an air-cooling operation and an air-warming operation and which performs a two-stage compression refrigeration cycle by using carbon dioxide as a refrigerant. This air-conditioning apparatus has primarily a compressor having two compression elements connected in series, a four-way switching valve for switching between an air-cooling operation and an air-warming operation, an outdoor heat exchanger, an expansion valve, and an indoor heat exchanger.

SUMMARY

A refrigeration apparatus according to a first aspect of the present invention is a refrigeration apparatus which a refrigerant that operates in a supercritical range is used, comprising a compression mechanism, a heat source-side heat exchanger which functions as a cooler or heater of refrigerant, an expansion mechanism for depressurizing the refrigerant, a usage-side heat exchanger which functions as a heater or cooler of refrigerant, a switching mechanism, an intercooler, and an intercooler bypass tube. The compression mechanism has a plurality of compression elements and is configured so that the refrigerant discharged from the first-stage compression element, which is one of a plurality of compression elements, is sequentially compressed by the second-stage compression element. The term "compression mechanism" herein means a compressor in which a plurality of compression elements are integrally incorporated, or a configuration including a compressor in which a single compression element is incorporated and/or a plurality of connected compressors in which a plurality of compression elements are incorporated in each. The phrase "the refrigerant discharged from a first-stage compression element, which is one of the plurality of compression elements, is sequentially compressed by a second-stage compression element" does not mean merely that two compression elements connected in series are included, namely, the "first-stage compression element" and the "second-stage compression element;" but means that a plurality of compression elements are connected in series and the relationship between the compression elements is the same as the relationship between the aforementioned "first-stage compression element" and "second-stage compression element." The switching mechanism is a mechanism for switching between a cooling operation state, in which the refrigerant is sequentially circulated through the compression mechanism, the heat source-side heat exchanger, the expansion mechanism, and the usage-side heat exchanger; and a heating operation state, in which the refrigerant is sequentially circulated through the compression mechanism, the usage-side heat exchanger, the expansion mechanism, and the heat source-side heat exchanger. The heat source-side heat exchanger is a heat exchanger having air as a heat source. The intercooler is a heat exchanger integrated with the heat source-side heat exchanger and having air as a heat source, is provided to an intermediate refrigerant tube for drawing refrigerant discharged from the first-stage compression element into the second-stage compression element, and functions as a cooler of the refrigerant discharged from the first-stage compression element and drawn into the second-stage compression element. The intercooler bypass tube is connected to the intermediate refrigerant tube so as to bypass the intercooler. The refrigeration apparatus is configured so that when the heat source-side heat exchanger is caused to function as a refrigerant cooler whereby a defrosting operation for defrosting the heat source-side heat exchanger is performed, the refrigerant is caused to flow to the heat source-side heat exchanger and the intercooler, and after defrosting of the intercooler is detected as being complete, the intercooler bypass tube is used so as to ensure that the refrigerant does not flow to the intercooler.

In a conventional air-conditioning apparatus, the critical temperature (about 31° C.) of carbon dioxide used as the refrigerant is about the same as the temperature of water or air as the cooling source of an outdoor heat exchanger or indoor heat exchanger functioning as a cooler of the refrigerant, which is low compared to R22, R410A, and other refrigerants, and the apparatus therefore operates in a state in which the high pressure of the refrigeration cycle is higher than the critical pressure of the refrigerant so that the refrigerant can be cooled by the water or air in these heat exchangers. As a result, since the refrigerant discharged from the second-stage compression element of the compressor has a high temperature, there is a large difference in temperature between the refrigerant and the water or air as a cooling source in the outdoor heat exchanger functioning as a refrigerant cooler, and the outdoor heat exchanger has much heat radiation loss, which poses a problem in making it difficult to achieve a high operating efficiency.

As a countermeasure to this problem, in this refrigeration apparatus, the intercooler which functions as a cooler of the refrigerant discharged from the first-stage compression element and drawn into the second-stage compression element is provided to the intermediate refrigerant tube for drawing refrigerant discharged from the first-stage compression element into the second-stage compression element, the intercooler bypass tube is connected to the intermediate refrigerant tube so as to bypass the intercooler, the intercooler bypass tube is used to ensure that the intercooler functions as a cooler when the switching mechanism corresponding to the aforementioned four-way switching valve is set to a cooling operation state corresponding to the air-cooling operation, and also that the intercooler does not function as a cooler when the switching mechanism is set to a heating operation state corresponding to the air-warming operation. This minimizes the temperature of the refrigerant discharged from the compression mechanism corresponding to the aforementioned compressor during the cooling operation, suppresses heat radiation from the intercooler to the exterior during the heating operation, and prevents loss of operating efficiency.

With this refrigeration apparatus, there is a danger of frost deposits forming in the intercooler in cases in which a heat exchanger whose heat source is air is used as the intercooler and the intercooler is integrated with a heat source-side heat exchanger whose heat source is air. Therefore, when a defrosting operation is performed in this refrigeration apparatus, refrigerant is made to flow to the heat source-side heat exchanger and the intercooler.

However, when the only measure taken during the heating operation is to prevent the intercooler from functioning as a cooler using an intercooler bypass tube, the amount of frost deposits in the intercooler is small and defrosting of the intercooler will conclude sooner than in the heat source-side heat exchanger. Therefore, if refrigerant continues to flow to the intercooler even after defrosting of the intercooler is complete, heat is radiated from the intercooler to the exterior and the temperature of the refrigerant drawn into the second-stage compression element decreases, and as a result, the temperature of the refrigerant discharged from the compression mechanism decreases, creating a problem of the loss of defrosting capacity of the heat source-side heat exchanger.

In view of this, in this refrigeration apparatus, after defrosting of the intercooler is detected as being complete, the intercooler bypass tube is used to ensure that refrigerant does not flow to the intercooler, whereby heat is not radiated from the intercooler to the exterior, the temperature decrease in the refrigerant drawn into the second-stage compression element is minimized, and as a result, the temperature decrease in the refrigerant discharged from the compression mechanism is minimized, and the loss of defrosting capacity of the heat source-side heat exchanger is minimized.

When the defrosting operation is performed in this refrigeration apparatus, it is thereby possible to defrost the intercooler as well and to minimize the loss of defrosting capacity caused by heat radiation from the intercooler to the exterior, which can also contribute to reducing the defrosting time.

A refrigeration apparatus according to a second aspect of the present invention is the refrigeration apparatus according to the first aspect of the present invention, wherein completion of the defrosting of the intercooler is detected based on the temperature of the refrigerant in an outlet of the intercooler.

In this refrigeration apparatus, it is possible to reliably detect that defrosting of the intercooler is complete by determining whether or not the refrigerant temperature at the outlet of the intercooler is equal to or greater than a predetermined temperature, for example.

A refrigeration apparatus according to a third aspect of the present invention is the refrigeration apparatus according to the first or second aspect of the present invention, wherein the refrigerant that operates in the supercritical range is carbon dioxide.

DETAILED DESCRIPTION OF EMBODIMENT(S)

Embodiments of the refrigeration apparatus according to the present invention are described hereinbelow with reference to the drawings.

(1) Configuration of Air-Conditioning Apparatus

Figure 1:
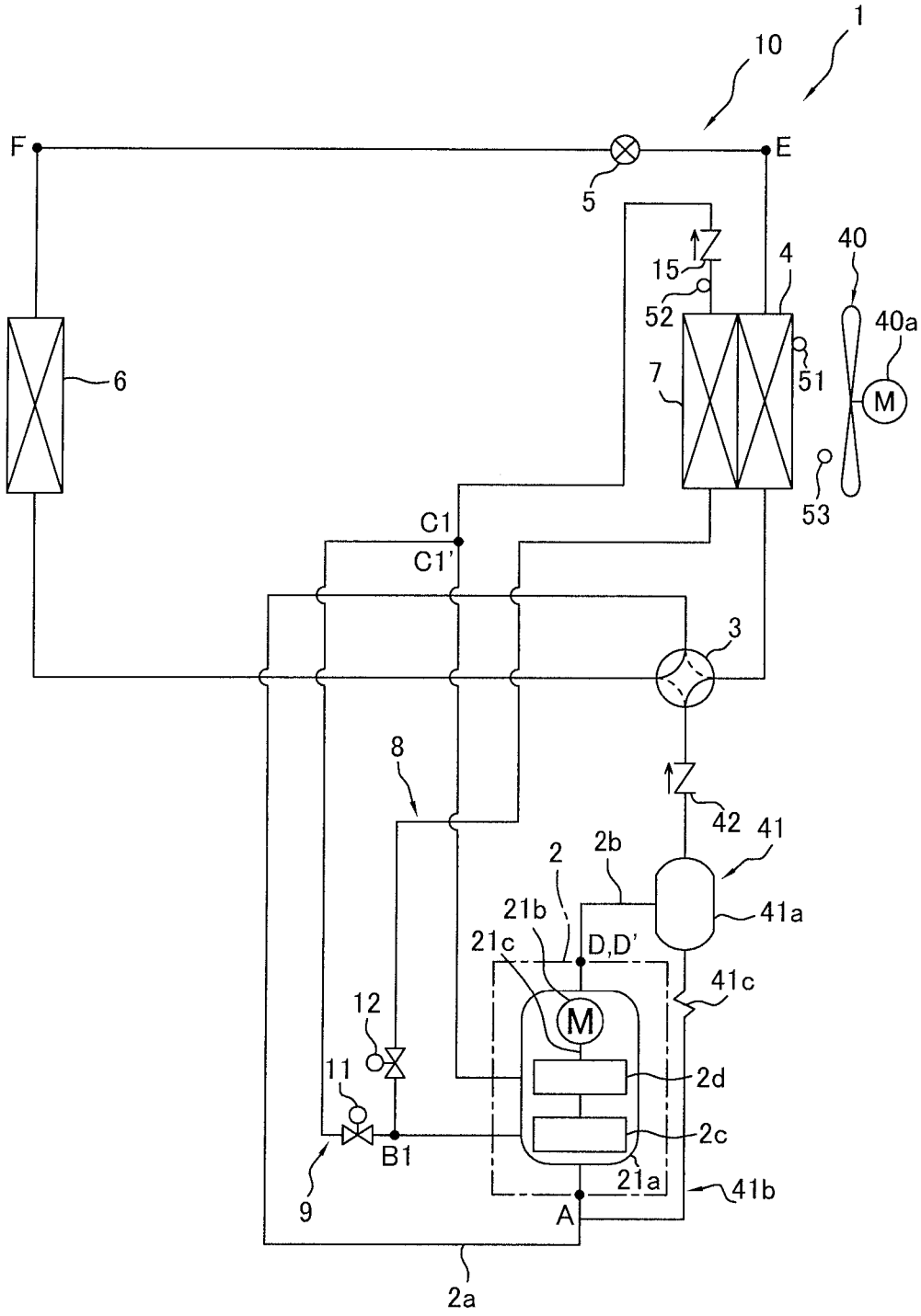
FIG. 1 is a schematic structural diagram of an air-conditioning apparatus as an embodiment of the refrigeration apparatus according to the present invention.

FIG. 1 is a schematic structural diagram of an air-conditioning apparatus 1 as an embodiment of the refrigeration apparatus according to the present invention. The air-conditioning apparatus 1 has a refrigerant circuit 10 configured to be capable of switching between an air-cooling operation and an air-warming operation, and the apparatus performs a two-stage compression refrigeration cycle by using a refrigerant (carbon dioxide in this case) for operating in a supercritical range.

The refrigerant circuit 10 of the air-conditioning apparatus 1 has primarily a compression mechanism 2, a switching mechanism 3, a heat source-side heat exchanger 4, an expansion mechanism 5, a usage-side heat exchanger 6, and an intercooler 7. In the present embodiment, the compression mechanism 2 is configured from a compressor 21 which uses two compression elements to subject a refrigerant to two-stage compression. The compressor 21 has a hermetic structure in which a compressor drive motor 21*b*, a drive shaft 21*c*, and compression elements 2*c*, 2*d* are housed within a casing 21*a*. The compressor drive motor 21*b* is linked to the drive shaft 21*c*. The drive shaft 21*c* is linked to the two compression elements 2*c*, 2*d*. Specifically, the compressor 21 has a so-called single-shaft two-stage compression structure in which the two compression elements 2*c*, 2*d* are linked to a single drive shaft 21*c* and the two compression elements 2*c*, 2*d* are both rotatably driven by the compressor drive motor 21*b*. In the present embodiment, the compression elements 2*c*, 2*d* are rotary elements, scroll elements, or another type of positive displacement compression elements. The compressor 21 is configured so as to admit refrigerant through an intake tube 2*a*, to discharge this refrigerant to an intermediate refrigerant tube 8 after the refrigerant has been compressed by the compression element 2*c*, to admit the refrigerant discharged to the intermediate refrigerant tube 8 into the compression element 2*d*, and to discharge the refrigerant to a discharge tube 2*b* after the refrigerant has been further compressed. The intermediate refrigerant tube 8 is a refrigerant tube for taking refrigerant into the compression element 2*d* connected to the second-stage side of the compression element 2*c* after the refrigerant has been discharged from the compression element 2*c* connected to the first-stage side of the compression element 2*c*. The discharge tube 2*b* is a refrigerant tube for feeding refrigerant discharged from the compression mechanism 2 to the switching mechanism 3, and the discharge tube 2*b* is provided with an oil separation mechanism 41 and a non-return mechanism 42. The oil separation mechanism 41 is a mechanism for separating refrigerator oil accompanying the refrigerant from the refrigerant discharged from the compression mechanism 2 and returning the oil to the intake side of the compression mechanism 2, and the oil separation mechanism 41 has primarily an oil separator 41*a* for separating refrigerator oil accompanying the refrigerant from the refrigerant discharged from the compression mechanism 2, and an oil return tube 41*b* connected to the oil separator 41*a* for returning the refrigerator oil separated from the refrigerant to the intake tube 2*a* of the compression mechanism 2. The oil return tube 41*b* is provided with a decompression mechanism 41*c* for depressurizing the refrigerator oil flowing through the oil return tube 41*b*. A capillary tube is used for the decompression mechanism 41*c* in the present embodiment. The non-return mechanism 42 is a mechanism for allowing the flow of refrigerant from the discharge side of the compression mechanism 2 to the switching mechanism 3 and for blocking the flow of refrigerant from the switching mechanism 3 to the discharge side of the compression mechanism 2, and a non-return valve is used in the present embodiment.

Thus, in the present embodiment, the compression mechanism 2 has two compression elements 2*c*, 2*d* and is configured so that among these compression elements 2*c*, 2*d*, refrigerant discharged from the first-stage compression element is compressed in sequence by the second-stage compression element.

The switching mechanism 3 is a mechanism for switching the direction of refrigerant flow in the refrigerant circuit 10. In order to allow the heat source-side heat exchanger 4 to function as a cooler of refrigerant compressed by the compression mechanism 2 and to allow the usage-side heat exchanger 6 to function as a heater of refrigerant cooled in the heat source-side heat exchanger 4 during the air-cooling operation, the switching mechanism 3 is capable of connecting the discharge side of the compression mechanism 2 and one end of the heat source-side heat exchanger 4 and also connecting the intake side of the compressor 21 and the usage-side heat exchanger 6 (refer to the solid lines of the switching mechanism 3 in FIG. 1, this state of the switching mechanism 3 is hereinbelow referred to as the "cooling operation state"). In order to allow the usage-side heat exchanger 6 to function as a cooler of refrigerant compressed by the compression mechanism 2 and to allow the heat source-side heat exchanger 4 to function as a heater of refrigerant cooled in the usage-side heat exchanger 6 during the air-warming operation, the switching mechanism 3 is capable of connecting the discharge side of the compression mechanism 2 and the usage-side heat exchanger 6 and also of connecting the intake side of the compression mechanism 2 and one end of the heat source-side heat exchanger 4 (refer to the dashed lines of the switching mechanism 3 in FIG. 1, this state of the switching mechanism 3 is hereinbelow referred to as the "heating operation state"). In the present embodiment, the switching mechanism 3 is a four-way switching valve connected to the intake side of the compression mechanism 2, the discharge side of the compression mechanism 2, the heat source-side heat exchanger 4, and the usage-side heat exchanger 6. The switching mechanism 3 is not limited to a four-way switching valve, and may also be configured by combining a plurality of electromagnetic valves, for example, so as to provide the same function of switching the direction of refrigerant flow as described above.

Thus, focusing solely on the compression mechanism 2, the heat source-side heat exchanger 4, the expansion mechanism 5, and the usage-side heat exchanger 6 constituting the refrigerant circuit 10; the switching mechanism 3 is configured so as to be capable of switching between the cooling operation state in which refrigerant is circulated in sequence through the compression mechanism 2, the heat source-side heat exchanger 4, the expansion mechanism 5, and the usage-side heat exchanger 6; and the heating operation state in which refrigerant is circulated in sequence through the compression mechanism 2, the usage-side heat exchanger 6, the expansion mechanism 5, and the heat source-side heat exchanger 4.

The heat source-side heat exchanger 4 is a heat exchanger that functions as a cooler or a heater of refrigerant. One end of the heat source-side heat exchanger 4 is connected to the switching mechanism 3, and the other end is connected to the expansion mechanism 5. The heat source-side heat exchanger 4 is a heat exchanger that uses air as a heat source (i.e., a cooling source or a heating source), and a fin-and-tube heat exchanger is used in the present embodiment. The air as the heat source is supplied to the heat source-side heat exchanger 4 by a heat source-side fan 40. The heat source-side fan 40 is driven by a fan drive motor 40*a*.

The expansion mechanism 5 is a mechanism for depressurizing the refrigerant, and an electric expansion valve is used in the present embodiment. One end of the expansion mechanism 5 is connected to the heat source-side heat exchanger 4, and the other end is connected to the usage-side heat exchanger 6. In the present embodiment, the expansion mechanism 5 depressurizes the high-pressure refrigerant cooled in the heat source-side heat exchanger 4 before feeding the refrigerant to the usage-side heat exchanger 6 during the air-cooling operation, and depressurizes the high-pressure refrigerant cooled in the usage-side heat exchanger 6 before feeding the refrigerant to the heat source-side heat exchanger 4 during the air-warming operation.

The usage-side heat exchanger 6 is a heat exchanger that functions as a heater or cooler of refrigerant. One end of the usage-side heat exchanger 6 is connected to the expansion mechanism 5, and the other end is connected to the switching mechanism 3. Though not shown in the drawings, the usage-side heat exchanger 6 is supplied with water or air as a heating source or cooling source for conducting heat exchange with the refrigerant flowing through the usage-side heat exchanger 6.

The intercooler 7 is provided to the intermediate refrigerant tube 8, and is a heat exchanger which functions as a cooler of refrigerant discharged from the compression element 2*c* on the first-stage side and drawn into the compression element 2*d*. The intercooler 7 is a heat exchanger that uses air as a heat source (i.e., a cooling source), and a fin-and-tube heat exchanger is used in the present embodiment. The intercooler 7 is integrated with the heat source-side heat exchanger 4. More specifically, the intercooler 7 is integrated by sharing heat transfer fins with the heat source-side heat exchanger 4. In the present embodiment, the air as the heat source is supplied by the heat source-side fan 40 for supplying air to the heat source-side heat exchanger 4. Specifically, the heat source-side fan 40 is designed so as to supply air as a heat source to both the heat source-side heat exchanger 4 and the intercooler 7.

An intercooler bypass tube 9 is connected to the intermediate refrigerant tube 8 so as to bypass the intercooler 7. This intercooler bypass tube 9 is a refrigerant tube for limiting the flow rate of refrigerant flowing through the intercooler 7. The intercooler bypass tube 9 is provided with an intercooler bypass on/off valve 11. The intercooler bypass on/off valve 11 is an electromagnetic valve in the present embodiment. Excluding cases in which temporary operations such as the hereinafter-described defrosting operation are performed, the intercooler bypass on/off valve 11 is essentially controlled so as to close when the switching mechanism 3 is set for the cooling operation, and to open when the switching mechanism 3 is set for the heating operation. In other words, the intercooler bypass on/off valve 11 is closed when the air-cooling operation is performed and opened when the air-warming operation is performed.

The intermediate refrigerant tube 8 is provided with a cooler on/off valve 12 in a position leading toward the intercooler 7 from the part connecting with the intercooler bypass tube 9 (i.e., in the portion leading from the part connecting with the intercooler bypass tube 9 nearer the inlet of the intercooler 7 to the connecting part nearer the outlet of the intercooler 7). The cooler on/off valve 12 is a mechanism for limiting the flow rate of refrigerant flowing through the intercooler 7. The cooler on/off valve 12 is an electromagnetic valve in the present embodiment. Excluding cases in which temporary operations such as the hereinafter-described defrosting operation are performed, the cooler on/off valve 12 is essentially controlled so as to open when the switching mechanism 3 is set for the cooling operation, and to close when the switching mechanism 3 is set for the heating operation. In other words, the cooler on/off valve 12 is controlled so as to open when the air-cooling operation is performed and close when the air-warming operation is performed. In the present embodiment, the cooler on/off valve 12 is provided in a position nearer the inlet of the intercooler 7, but may also be provided in a position nearer the outlet of the intercooler 7.

The intermediate refrigerant tube 8 is also provided with a non-return mechanism 15 for allowing refrigerant to flow from the discharge side of the first-stage compression element 2*c* to the intake side of the second-stage compression element 2*d* and for blocking the refrigerant from flowing from the discharge side of the second-stage compression element 2*d* to the first-stage compression element 2*c*. The non-return mechanism 15 is a non-return valve in the present embodiment. In the present embodiment, the non-return mechanism 15 is provided to the intermediate refrigerant tube 8 in the portion leading away from the outlet of the intercooler 7 toward the part connecting with the intercooler bypass tube 9.

Furthermore, the air-conditioning apparatus 1 is provided with various sensors. Specifically, the heat source-side heat exchanger 4 is provided with a heat source-side heat exchange temperature sensor 51 for detecting the temperature of the refrigerant flowing through the heat source-side heat exchanger 4. The outlet of the intercooler 7 is provided with an intercooler outlet temperature sensor 52 for detecting the temperature of refrigerant at the outlet of the intercooler 7. The air-conditioning apparatus 1 is provided with an air temperature sensor 53 for detecting the temperature of the air as a heat source for the heat source-side heat exchanger 4 and intercooler 7. Though not shown in the drawings, the air-conditioning apparatus 1 has a controller for controlling the actions of the compression mechanism 2, the switching mechanism 3, the expansion mechanism 5, the heat source-side fan 40, the intercooler bypass on/off valve 11, the cooler on/off valve 12, and the other components constituting the air-conditioning apparatus 1.

(2) Action of the Air-Conditioning Apparatus

Figure 2:
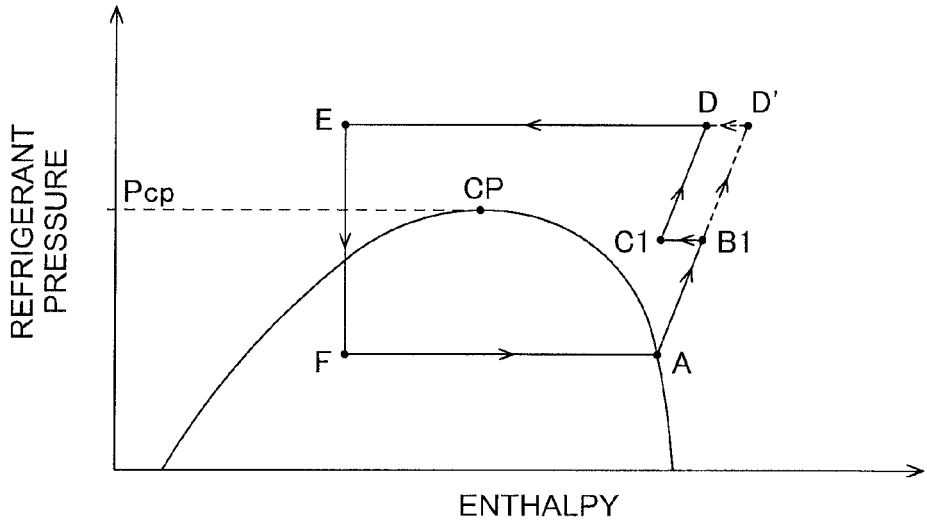
FIG. 2 is a pressure-enthalpy graph representing the refrigeration cycle during the air-cooling operation.
Figure 3:
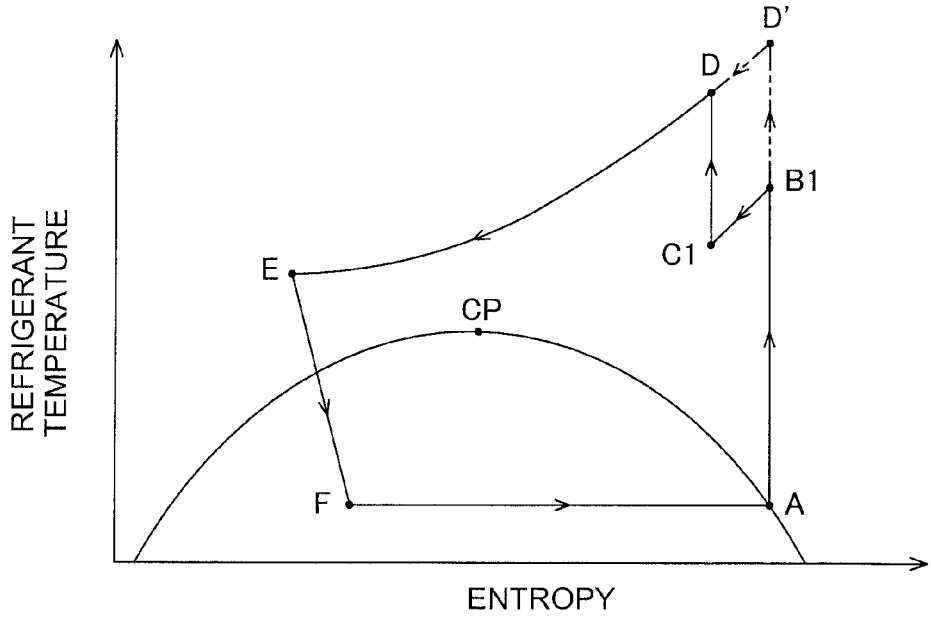
FIG. 3 is a temperature-entropy graph representing the refrigeration cycle during the air-cooling operation.
Figure 4:
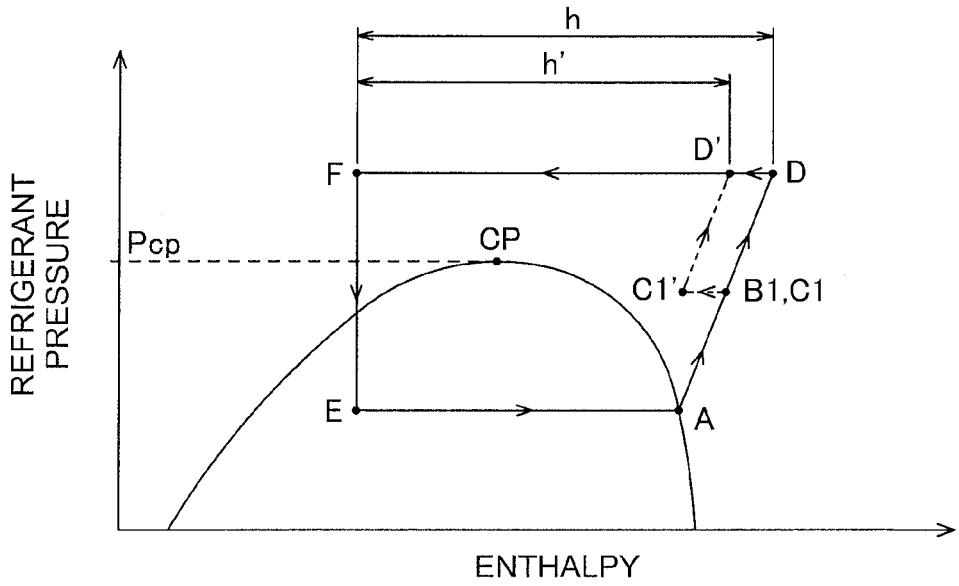
FIG. 4 is a pressure-enthalpy graph representing the refrigeration cycle during the air-warming operation.
Figure 5:
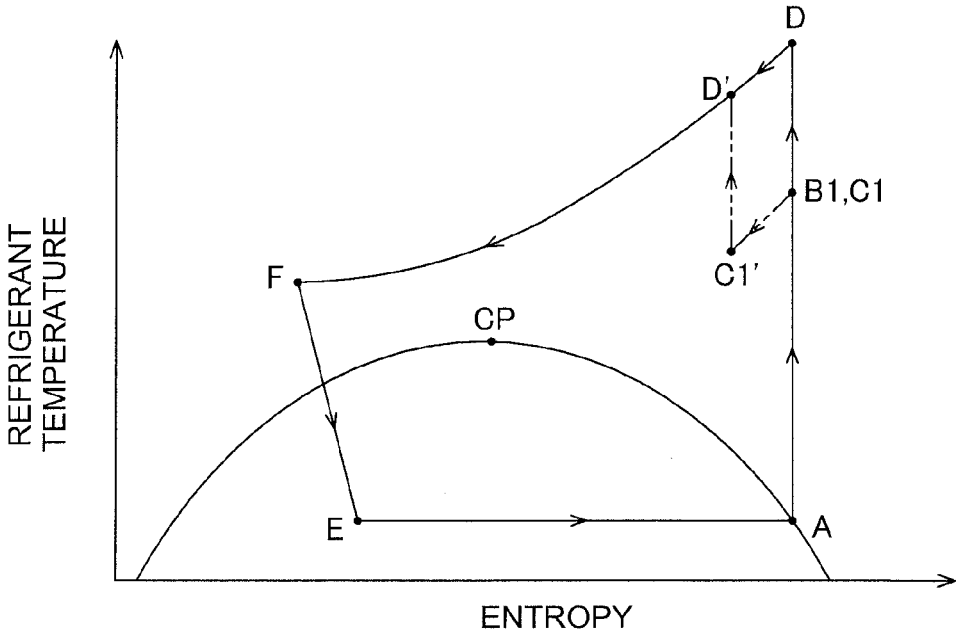
FIG. 5 is a temperature-entropy graph representing the refrigeration cycle during the air-warming operation.
Figure 6:
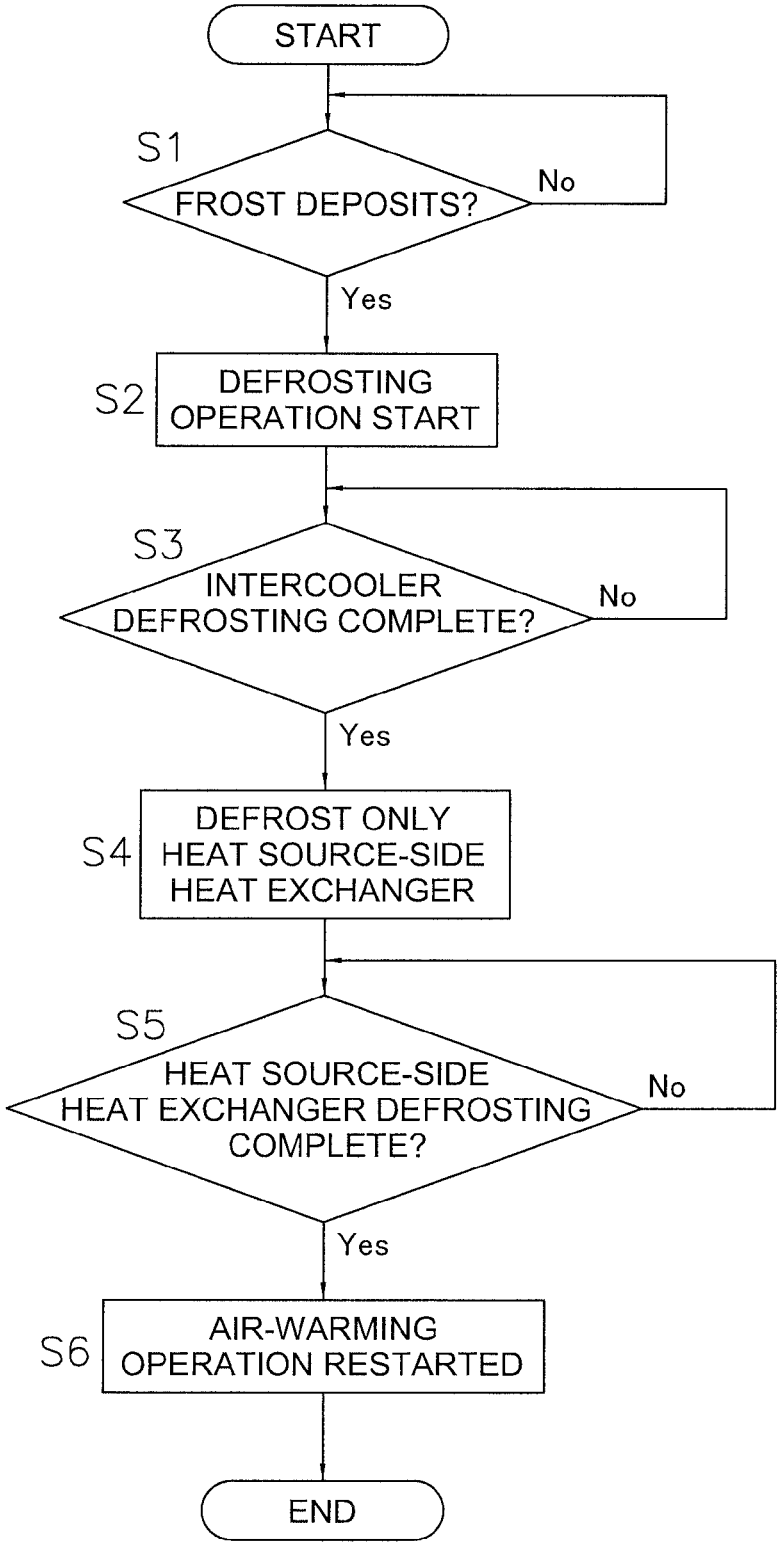
FIG. 6 is a flowchart of the defrosting operation.
Figure 7:
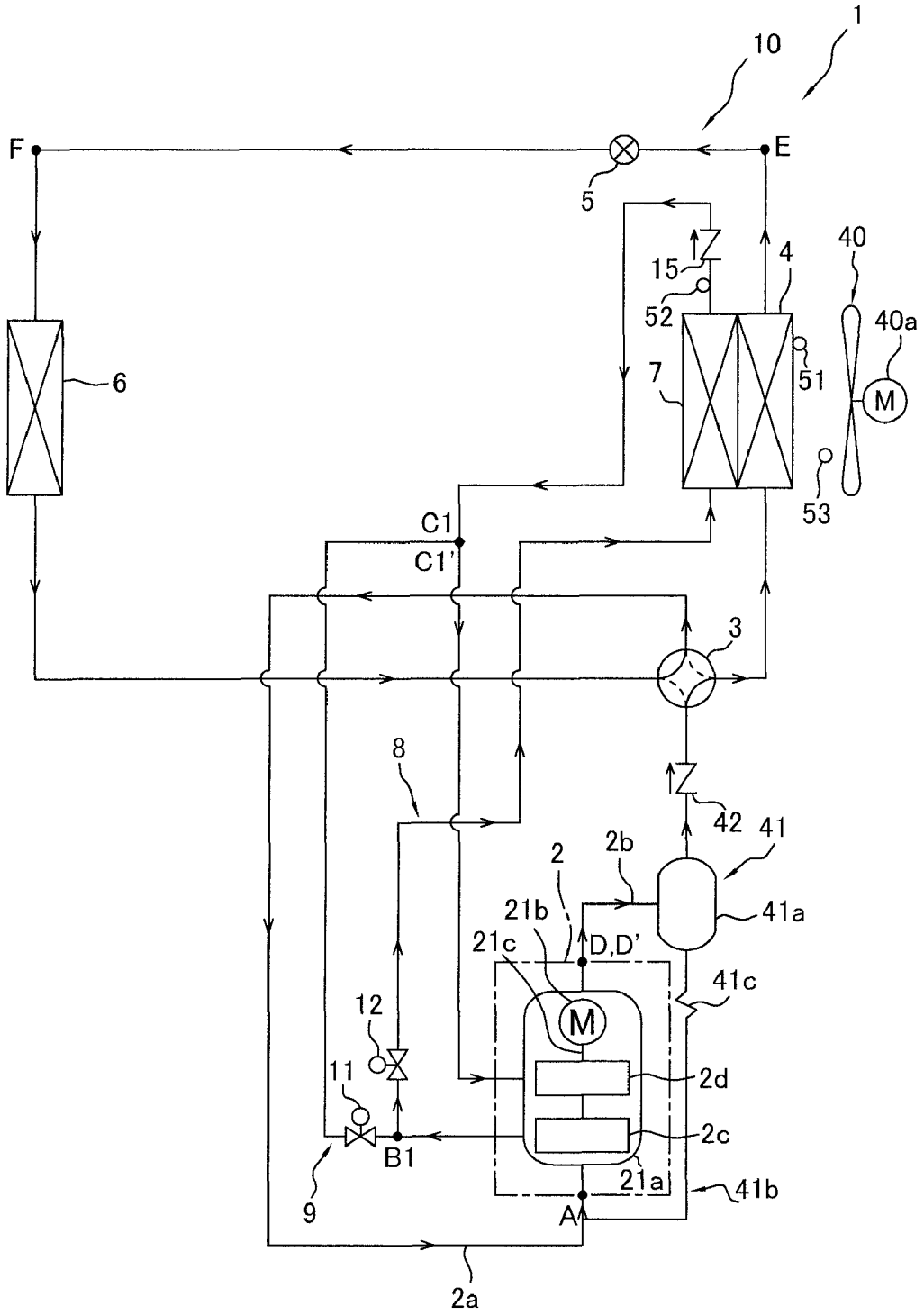
FIG. 7 is a diagram showing the flow of refrigerant within the air-conditioning apparatus at the start of the defrosting operation.
Figure 8:
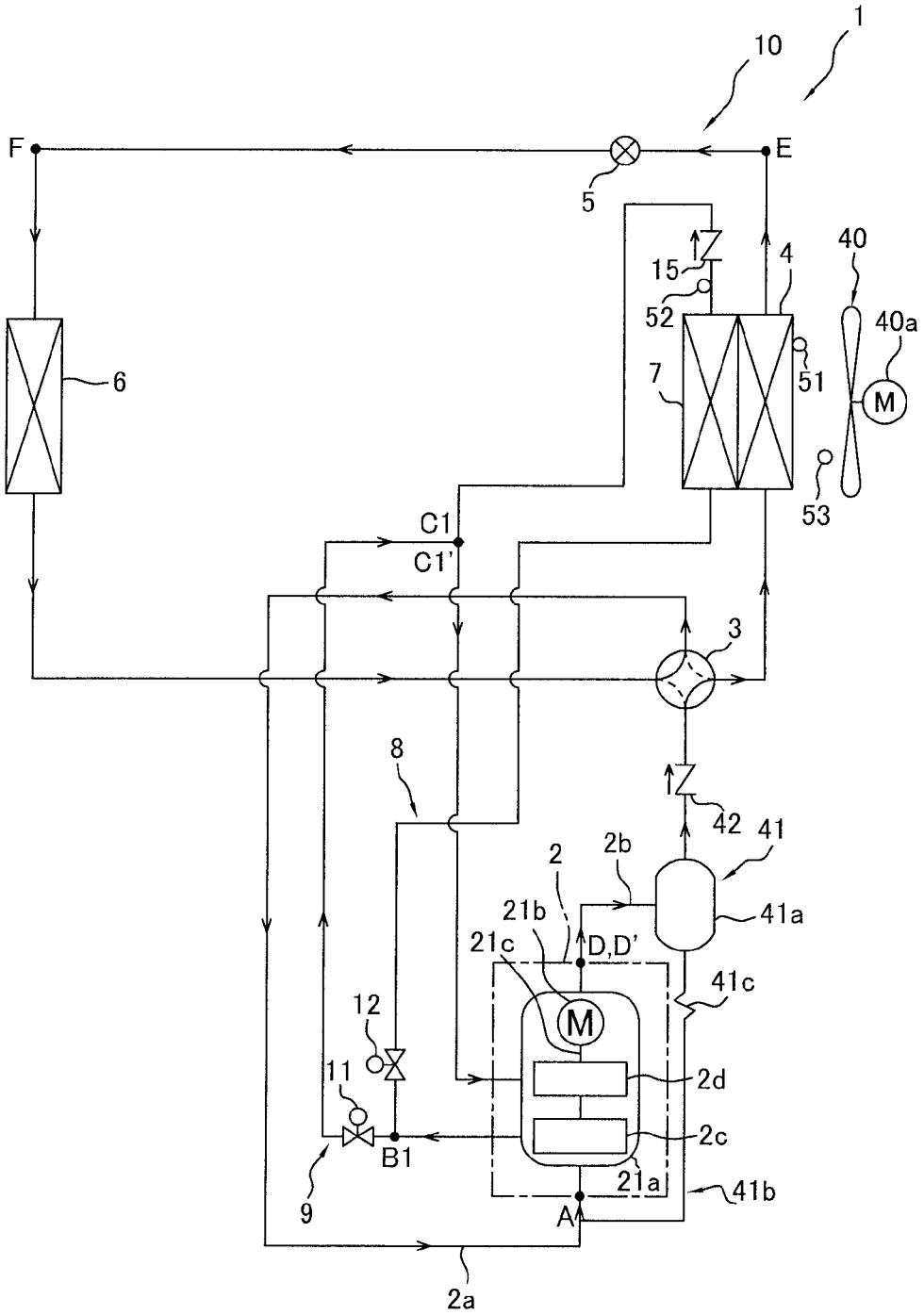
FIG. 8 is a diagram showing the flow of refrigerant within the air-conditioning apparatus after defrosting of the intercooler is complete.

Next, the action of the air-conditioning apparatus 1 of the present embodiment will be described using FIGS. 1 through 8. FIG. 2 is a pressure-enthalpy graph representing the refrigeration cycle during the air-cooling operation, FIG. 3 is a temperature-entropy graph representing the refrigeration cycle during the air-cooling operation, FIG. 4 is a pressure-enthalpy graph representing the refrigeration cycle during the air-warming operation, FIG. 5 is a temperature-entropy graph representing the refrigeration cycle during the air-warming operation, FIG. 6 is a flowchart of the defrosting operation, FIG. 7 is a diagram showing the flow of refrigerant within the air-conditioning apparatus 1 at the start of the defrosting operation, and FIG. 8 is a diagram showing the flow of refrigerant within the air-conditioning apparatus 1 after defrosting of the intercooler is complete. Operation controls during the following air-cooling operation, air-warming operation, and defrosting operation are performed by the aforementioned controller (not shown). In the following description, the term "high pressure" means a high pressure in the refrigeration cycle (specifically, the pressure at points D, D', and E in FIGS. 2 and 3, and the pressure at points D, D', and F in FIGS. 4 and 5), the term "low pressure" means a low pressure in the refrigeration cycle (specifically, the pressure at points A and F in FIGS. 2 and 3, and the pressure at points A and E in FIGS. 4 and 5), and the term "intermediate pressure" means an intermediate pressure in the refrigeration cycle (specifically, the pressure at points B1, C1, and C1' in FIGS. 2 through 5).

<Air-cooling Operation>

During the air-cooling operation, the switching mechanism 3 is set for the cooling operation as shown by the solid lines in FIG. 1. The opening degree of the expansion mechanism 5 is adjusted. Since the switching mechanism 3 is set for the cooling operation, the cooler on/off valve 12 is opened and the intercooler bypass on/off valve 11 of the intercooler bypass tube 9 is closed, whereby the intercooler 7 is set to function as a cooler.

When the compression mechanism 2 is driven while the refrigerant circuit 10 is in this state, low-pressure refrigerant (refer to point A in FIGS. 1 through 3) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 1 through 3). The intermediate-pressure refrigerant discharged from the first-stage compression element 2*c* is cooled in the intercooler 7 by undergoing heat exchange with the air as a cooling source (refer to point C1 in FIGS. 1 through 3). The refrigerant cooled in the intercooler 7 is then led to and further compressed in the compression element 2*d* connected to the second-stage side of the compression element 2*c* after passing through the non-return mechanism 15, and the refrigerant is then discharged from the compression mechanism 2 to the discharge tube 2*b* (refer to point D in FIGS. 1 through 3). The high-pressure refrigerant discharged from the compression mechanism 2 is compressed to a pressure exceeding a critical pressure (i.e., the critical pressure Pcp at the critical point CP shown in FIG. 2) by the two-stage compression action of the compression elements 2*c*, 2*d*. The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant cooler. The high-pressure refrigerant fed to the heat source-side heat exchanger 4 is cooled in the heat source-side heat exchanger 4 by heat exchange with air as a cooling source (refer to point E in FIGS. 1 through 3). The high-pressure refrigerant cooled in the heat source-side heat exchanger 4 is then depressurized by the expansion mechanism 5 to become a low-pressure gas-liquid two-phase refrigerant, which is fed to the usage-side heat exchanger 6 functioning as a refrigerant heater (refer to point F in FIGS. 1 through 3). The low-pressure gas-liquid two-phase refrigerant fed to the usage-side heat exchanger 6 is heated by heat exchange with water or air as a heating source, and the refrigerant evaporates as a result (refer to point A in FIGS. 1 through 3). The low-pressure refrigerant heated in the usage-side heat exchanger 6 is then led back into the compression mechanism 2 via the switching mechanism 3. In this manner the air-cooling operation is performed.

Thus, in the air-conditioning apparatus 1, the intercooler 7 is provided to the intermediate refrigerant tube 8 for letting refrigerant discharged from the compression element 2*c* into the compression element 2*d*, and during the air-cooling operation in which the switching mechanism 3 is set to a cooling operation state, the cooler on/off valve 12 is opened and the intercooler bypass on/off valve 11 of the intercooler bypass tube 9 is closed, thereby putting the intercooler 7 into a state of functioning as a cooler. Therefore, the refrigerant drawn into the compression element 2*d* on the second-stage side of the compression element 2*c* decreases in temperature (refer to points B1 and C1 in FIG. 3) and the refrigerant discharged from the compression element 2*d* also decreases in temperature (refer to points D and D' in FIG. 3), in comparison with cases in which no intercooler 7 is provided (in this case, the refrigeration cycle is performed in the sequence in FIGS. 2 and 3: point A→point B1→point D'→point E→point F). Therefore, in the heat source-side heat exchanger 4 functioning as a cooler of high-pressure refrigerant in this air-conditioning apparatus 1, operating efficiency can be improved over cases in which no intercooler 7 is provided, because the temperature difference between the refrigerant and water or air as the cooling source can be reduced, and heat radiation loss can be reduced by an amount equivalent to the area enclosed by connecting points B1, D', D, and C1 in FIG. 3.

<Air-warming Operation>

During the air-warming operation, the switching mechanism 3 is set to a heating operation state shown by the dashed lines in FIG. 1. The opening degree of the expansion mechanism 5 is adjusted. Since the switching mechanism 3 is set to a heating operation state, the cooler on/off valve 12 is closed and the intercooler bypass on/off valve 11 of the intercooler bypass tube 9 is opened, thereby putting the intercooler 7 into a state of not functioning as a cooler.

When the compression mechanism 2 is driven during this state of the refrigerant circuit 10, low-pressure refrigerant (refer to point A in FIGS. 1, 4, and 5) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 1, 4, and 5). The intermediate-pressure refrigerant discharged from the first-stage compression element 2*c* passes through the intercooler bypass tube 9 (refer to point C1 in FIGS. 1, 4, and 5) without passing through the intercooler 7 (i.e., without being cooled), unlike in the air-cooling operation. The refrigerant is drawn into and further compressed in the compression element 2*d* connected to the second-stage side of the compression element 2*c*, and is discharged from the compression mechanism 2 to the discharge tube 2*b* (refer to point D in FIGS. 1, 4, and 5). The high-pressure refrigerant discharged from the compression mechanism 2 is compressed to a pressure exceeding a critical pressure (i.e., the critical pressure Pcp at the critical point CP shown in FIG. 4) by the two-stage compression action of the compression elements 2*c*, 2*d*, similar to the air-cooling operation. The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3, and is fed to the usage-side heat exchanger 6 functioning as a refrigerant cooler. The high-pressure refrigerant fed to the usage-side heat exchanger 6 is cooled in the usage-side heat exchanger 6 by heat exchange with water or air as a cooling source (refer to point F in FIGS. 1, 4, and 5). The high-pressure refrigerant cooled in the usage-side heat exchanger 6 is then depressurized by the expansion mechanism 5 to become a low-pressure gas-liquid two-phase refrigerant, which is fed to the heat source-side heat exchanger 4 functioning as a refrigerant heater (refer to point E in FIGS. 1, 4, and 5). The low-pressure gas-liquid two-phase refrigerant fed to the heat source-side heat exchanger 4 is heated by heat exchange with air as a heating source, and the refrigerant evaporates as a result (refer to point A in FIGS. 1, 4, and 5). The low-pressure refrigerant heated in the heat source-side heat exchanger 4 is then led back into the compression mechanism 2 via the switching mechanism 3. In this manner the air-warming operation is performed.

Thus, in the air-conditioning apparatus 1, the intercooler 7 is provided to the intermediate refrigerant tube 8 for letting refrigerant discharged from the compression element 2*c* into the compression element 2*d*, and during the air-warming operation in which the switching mechanism 3 is set to the heating operation state, the cooler on/off valve 12 is closed and the intercooler bypass on/off valve 11 of the intercooler bypass tube 9 is opened, thereby putting the intercooler 7 into a state of not functioning as a cooler. Therefore, the temperature decrease is minimized in the refrigerant discharged from the compression mechanism 2 (refer to points D and D' in FIG. 5), in comparison with cases in which only the intercooler 7 is provided or cases in which the intercooler 7 is made to function as a cooler similar to the air-cooling operation described above (in these cases, the refrigeration cycle is performed in the sequence in FIGS. 4 and 5: point A→point B1→point C1→point D'→point F→point E). Therefore, in the air-conditioning apparatus 1, heat radiation to the exterior can be minimized, temperature decreases can be minimized in the refrigerant supplied to the usage-side heat exchanger 6 functioning as a refrigerant cooler, loss of heating performance can be minimized in proportion to the difference between the enthalpy difference h of points D and F and the enthalpy difference h' of points D' and F in FIG. 4, and loss of operating efficiency can be prevented, in comparison with cases in which only the intercooler 7 is provided or cases in which the intercooler 7 is made to function as a cooler similar to the air-cooling operation described above.

In the air-conditioning apparatus 1 as described above, not only is the intercooler 7 provided but the cooler on/off valve 12 and intercooler bypass tube 9 are provided as well. When these components are used to put the switching mechanism 3 into a cooling operation state, the intercooler 7 is made to function as a cooler, and when the switching mechanism 3 is brought to a heating operation state, the intercooler 7 does not function as a cooler. Therefore, in the air-conditioning apparatus 1, the temperature of the refrigerant discharged from the compression mechanism 2 can be kept low during the cooling operation as an air-cooling operation, and temperature decreases can be minimized in the refrigerant discharged from the compression mechanism 2 during the heating operation as an air-warming operation. During the air-cooling operation, heat radiation loss can be reduced in the heat source-side heat exchanger 4 functioning as a refrigerant cooler and operating efficiency can be improved, and during the air-warming operation, loss of heating performance can be minimized by minimizing temperature decreases in the refrigerant supplied to the usage-side heat exchanger 6 functioning as a refrigerant cooler, and decreases in operating efficiency can be prevented.

<Defrosting Operation>

In this air-conditioning apparatus 1, when the air-warming operation is performed while the air as the heat source of the heat source-side heat exchanger 4 has a low temperature, frost deposits form on the heat source-side heat exchanger 4 functioning as a refrigerant heater, and there is a danger that the heat transfer performance of the heat source-side heat exchanger 4 will thereby suffer. Defrosting of the heat source-side heat exchanger 4 must therefore be performed.

The defrosting operation of the present embodiment is described in detail hereinbelow using FIGS. 6 through 8.

First, in step S1, a determination is made as to whether or not frost deposits have formed on the heat source-side heat exchanger 4 during the air-warming operation. This is determined based on the temperature of the refrigerant flowing through the heat source-side heat exchanger 4 as detected by the heat source-side heat exchange temperature sensor 51, and/or on the cumulative time of the air-warming operation. For example, in cases in which the temperature of refrigerant in the heat source-side heat exchanger 4 as detected by the heat source-side heat exchange temperature sensor 51 is equal to or less than a predetermined temperature equivalent to conditions at which frost deposits occur, or in cases in which the cumulative time of the air-warming operation has elapsed past a predetermined time, it is determined that frost deposits have occurred in the heat source-side heat exchanger 4. In cases in which these temperature conditions or time conditions are not met, it is determined that frost deposits have not occurred in the heat source-side heat exchanger 4. Since the predetermined temperature and predetermined time depend on the temperature of the air as a heat source, the predetermined temperature and predetermined time are preferably set as a function of the air temperature detected by the air temperature sensor 53. In cases in which a temperature sensor is provided to the inlet or outlet of the heat source-side heat exchanger 4, the refrigerant temperature detected by these temperature sensors may be used in the determination of the temperature conditions instead of the refrigerant temperature detected by the heat source-side heat exchange temperature sensor 51. In cases in which it is determined in step S1 that frost deposits have occurred in the heat source-side heat exchanger 4, the process advances to step S2.

Next, in step S2, the defrosting operation is started. The defrosting operation is a reverse cycle defrosting operation in which the heat source-side heat exchanger 4 is made to function as a refrigerant cooler by switching the switching mechanism 3 from the heating operation state (i.e., the air-warming operation) to the cooling operation state. Moreover, there is a danger in the present embodiment that frost deposits will occur in the intercooler 7 as well because a heat exchanger whose heat source is air is used as the intercooler 7 and the intercooler 7 is integrated with the heat source-side heat exchanger 4; therefore, refrigerant must be passed through not only the heat source-side heat exchanger 4 but also the intercooler 7 and the intercooler 7 must be defrosted. In view of this, at the start of the defrosting operation, similar to the air-cooling operation described above, an operation is performed whereby the heat source-side heat exchanger 4 is made to function as a refrigerant cooler by switching the switching mechanism 3 from the heating operation state (i.e., the air-warming operation) to the cooling operation state (i.e., the air-cooling operation), the cooler on/off valve 12 is opened, and the intercooler bypass on/off valve 11 is closed, and the intercooler 7 is thereby made to function as a cooler (refer to the arrows indicating the flow of refrigerant in FIG. 7).

Next, in step S3, a determination is made as to whether or not defrosting of the intercooler 7 is complete. The reason for determining whether or not defrosting of the intercooler 7 is complete is because the intercooler 7 is made to not function as a cooler by the intercooler bypass tube 9 during the air-warming operation as described above; therefore, the amount of frost deposited in the intercooler 7 is small, and defrosting of the intercooler 7 is completed sooner than the heat source-side heat exchanger 4. This determination is made based on the refrigerant temperature at the outlet of the intercooler 7. For example, in the case that the refrigerant temperature at the outlet of the intercooler 7 as detected by the intercooler outlet temperature sensor 52 is detected to be equal to or greater than a predetermined temperature, defrosting of the intercooler 7 is determined to be complete, and in the case that this temperature condition is not met, it is determined that defrosting of the intercooler 7 is not complete. It is possible to reliably detect that defrosting of the intercooler 7 has completed by this determination based on the refrigerant temperature at the outlet of the intercooler 7. In the case that it has been determined in step S3 that defrosting of the intercooler 7 is complete, the process advances to step S4.

Next, the process transitions in step S4 from the operation of defrosting both the intercooler 7 and the heat source-side heat exchanger 4 to an operation of defrosting only the heat source-side heat exchanger 4. The reason this operation transition is made after defrosting of the intercooler 7 is complete is because when refrigerant continues to flow to the intercooler 7 even after defrosting of the intercooler 7 is complete, heat is radiated from the intercooler 7 to the exterior, the temperature of the refrigerant drawn into the second-stage compression element 2*d* decreases, and as a result, a problem occurs in that the temperature of the refrigerant discharged from the compression mechanism 2 decreases and the defrosting capacity of the heat source-side heat exchanger 4 suffers. The operation transition is therefore made so that this problem does not occur. This operation transition in step S4 allows an operation to be performed for making the intercooler 7 not function as a cooler, by closing the cooler on/off valve 12 and opening the intercooler bypass on/off valve 11 while the heat source-side heat exchanger 4 continues to be defrosted by the reverse cycle defrosting operation (refer to the arrows indicating the flow of refrigerant in FIG. 8). Heat is thereby prevented from being radiated from the intercooler 7 to the exterior, the temperature of the refrigerant drawn into the second-stage compression element 2*d* is therefore prevented from decreasing, and as a result, temperature decreases can be minimized in the refrigerant discharged from the compression mechanism 2, and the decrease in the capacity to defrost the heat source-side heat exchanger 4 can be minimized.

Next, in step S5, a determination is made as to whether or not defrosting of the heat source-side heat exchanger 4 has completed. This determination is made based on the temperature of refrigerant flowing through the heat source-side heat exchanger 4 as detected by the heat source-side heat exchange temperature sensor 51, and/or on the operation time of the defrosting operation. For example, in the case that the temperature of refrigerant in the heat source-side heat exchanger 4 as detected by the heat source-side heat exchange temperature sensor 51 is equal to or greater than a temperature equivalent to conditions at which frost deposits do not occur, or in the case that the defrosting operation has continued for a predetermined time or longer, it is determined that defrosting of the heat source-side heat exchanger 4 has completed. In the case that the temperature conditions or time conditions are not met, it is determined that defrosting of the heat source-side heat exchanger 4 is not complete. In the case that a temperature sensor is provided to the inlet or outlet of the heat source-side heat exchanger 4, the temperature of the refrigerant as detected by either of these temperature sensors may be used in the determination of the temperature conditions instead of the refrigerant temperature detected by the heat source-side heat exchange temperature sensor 51. In cases in which it is determined in step S5 that defrosting of the heat source-side heat exchanger 4 has completed, the process transitions to step S6, the defrosting operation ends, and the process for restarting the air-warming operation is again performed. More specifically, a process is performed for switching the switching mechanism 3 from the cooling operation state to the heating operation state (i.e. the air-warming operation).

As described above, in the air-conditioning apparatus 1, when a defrosting operation is performed for defrosting the heat source-side heat exchanger 4 by making the heat source-side heat exchanger 4 function as a refrigerant cooler, the refrigerant flows to the heat source-side heat exchanger 4 and the intercooler 7, and after it is detected that defrosting of the intercooler 7 is complete, the intercooler bypass tube 9 is used to ensure that refrigerant no longer flows to the intercooler 7. It is thereby possible, when the defrosting operation is performed in the air-conditioning apparatus 1, to also defrost the intercooler 7, to minimize the loss of defrosting capacity resulting from the radiation of heat from the intercooler 7 to the exterior, and to contribute to reducing defrosting time.

(3) Modification 1

In the embodiment described above, in the air-conditioning apparatus 1 configured to be capable of being switched between the air-cooling operation and the air-warming operation by the switching mechanism 3, the air-cooling intercooler 7 integrated with the heat source-side heat exchanger 4 and the intercooler bypass tube 9 were provided. Using the intercooler 7 and the intercooler bypass tube 9, the intercooler 7 was made to function as a cooler when the switching mechanism 3 was set to a cooling operation state and the intercooler 7 was made to not function as a cooler when the switching mechanism 3 was set to a heating operation state, thereby reducing the heat radiation loss in the heat source-side heat exchanger 4 functioning as a refrigerant cooler and improving operating efficiency during the air-cooling operation, and minimizing heat radiation to the exterior to minimize the loss of heating performance during the air-warming operation. In addition to this configuration, another possibility under consideration is to further provide a second-stage injection tube for branching off the refrigerant cooled in the heat source-side heat exchanger 4 or the usage-side heat exchanger 6 and returning the refrigerant to the second-stage compression element 2*d*.

Figure 9:
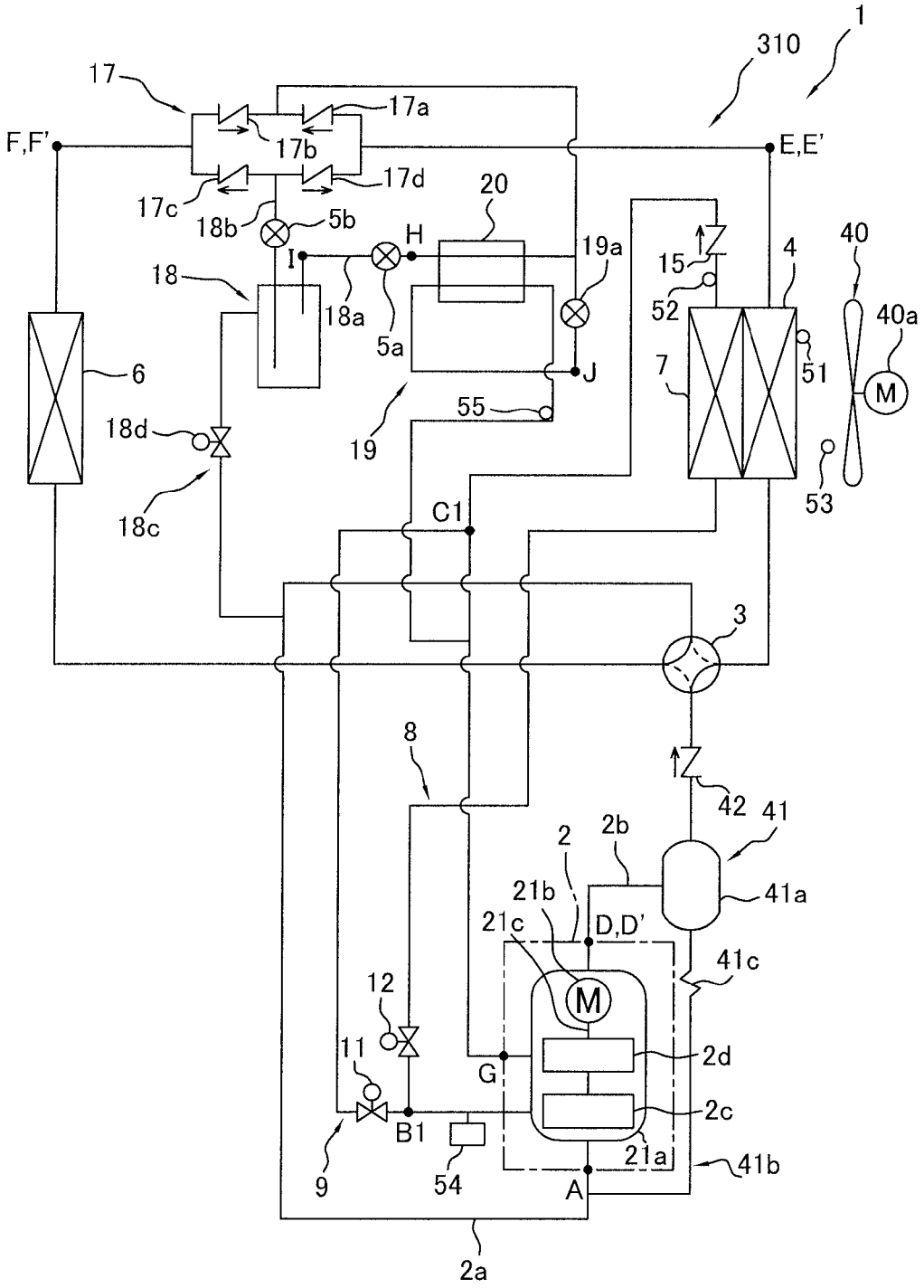
FIG. 9 is a schematic structural diagram of an air-conditioning apparatus according to Modification 1.

For example, in the above-described embodiment in which the two-stage compression-type compression mechanism 2 is used, a refrigerant circuit 310 can be used in which a receiver inlet expansion mechanism 5*a* and a receiver outlet expansion mechanism 5*b* can be provided instead of the expansion mechanism 5, and a bridge circuit 17, a receiver 18, the second-stage injection tube 19, and an economizer heat exchanger 20 are provided as shown in FIG. 9.

The bridge circuit 17 is provided between the heat source-side heat exchanger 4 and the usage-side heat exchanger 6, and is connected to a receiver inlet tube 18*a* connected to an inlet of the receiver 18, and to a receiver outlet tube 18*b* connected to an outlet of the receiver 18. The bridge circuit 17 has four non-return valves 17*a*, 17*b*, 17*c* and 17*d* in the present modification. The inlet non-return valve 17*a* is a non-return valve for allowing refrigerant to flow only from the heat source-side heat exchanger 4 to the receiver inlet tube 18*a*. The inlet non-return valve 17*b* is a non-return valve for allowing refrigerant to flow only from the usage-side heat exchanger 6 to the receiver inlet tube 18*a*. In other words, the inlet non-return valves 17*a*, 17*b* have the function of allowing refrigerant to flow to the receiver inlet tube 18*a* from either the heat source-side heat exchanger 4 or the usage-side heat exchanger 6. The outlet non-return valve 17*c* is a non-return valve for allowing refrigerant to flow only from the receiver outlet tube 18*b* to the usage-side heat exchanger 6. The outlet non-return valve 17*d* is a non-return valve for allowing refrigerant to flow only from the receiver outlet tube 18*b* to the heat source-side heat exchanger 4. In other words, the outlet non-return valves 17*c*, 17*d* have the function of allowing the refrigerant to flow from the receiver outlet tube 18*b* to the other of the heat source-side heat exchanger 4 and the usage-side heat exchanger 6.

The receiver inlet expansion mechanism 5*a* is a refrigerant-depressurizing mechanism provided to the receiver inlet tube 18*a*, and an electric expansion valve is used in the present modification. In the present modification, the receiver inlet expansion mechanism 5*a* depressurizes the high-pressure refrigerant cooled in the heat source-side heat exchanger 4 before feeding the refrigerant to the usage-side heat exchanger 6 during the air-cooling operation, and depressurizes the high-pressure refrigerant cooled in the usage-side heat exchanger 6 before feeding the refrigerant to the heat source-side heat exchanger 4 during the air-warming operation.

The receiver 18 is a container provided in order to temporarily retain refrigerant after it is depressurized by the receiver inlet expansion mechanism 5*a*, wherein the inlet of the receiver is connected to the receiver inlet tube 18*a* and the outlet is connected to the receiver outlet tube 18*b*. Also connected to the receiver 18 is an intake return tube 18*c* capable of withdrawing refrigerant from inside the receiver 18 and returning the refrigerant to the intake tube 2*a* of the compression mechanism 2 (i.e., to the intake side of the compression element 2*c* on the first-stage side of the compression mechanism 2). The intake return tube 18*c* is provided with an intake return on/off valve 18*d*. The intake return on/off valve 18*d* is an electromagnetic valve in the present modification.

The receiver outlet expansion mechanism 5*b* is a refrigerant-depressurizing mechanism provided to the receiver outlet tube 18*b*, and an electric expansion valve is used in the present modification. In the present modification, the receiver outlet expansion mechanism 5*b* further depressurizes refrigerant depressurized by the receiver inlet expansion mechanism 5*a* to an even lower pressure before feeding the refrigerant to the usage-side heat exchanger 6 during the air-cooling operation, and further depressurizes refrigerant depressurized by the receiver inlet expansion mechanism 5*a* to an even lower pressure before feeding the refrigerant to the heat source-side heat exchanger 4.

Thus, when the switching mechanism 3 is brought to the cooling operation state by the bridge circuit 17, the receiver 18, the receiver inlet tube 18*a*, and the receiver outlet tube 18*b*, the high-pressure refrigerant cooled in the heat source-side heat exchanger 4 can be fed to the usage-side heat exchanger 6 through the inlet non-return valve 17*a* of the bridge circuit 17, the receiver inlet expansion mechanism 5*a* of the receiver inlet tube 18*a*, the receiver 18, the receiver outlet expansion mechanism 5*b* of the receiver outlet tube 18*b*, and the outlet non-return valve 17*c* of the bridge circuit 17. When the switching mechanism 3 is brought to the heating operation state, the high-pressure refrigerant cooled in the usage-side heat exchanger 6 can be fed to the heat source-side heat exchanger 4 through the inlet non-return valve 17*b* of the bridge circuit 17, the receiver inlet expansion mechanism 5*a* of the receiver inlet tube 18*a*, the receiver 18, the receiver outlet expansion mechanism 5*b* of the receiver outlet tube 18*b*, and the outlet non-return valve 17*d* of the bridge circuit 17.

The second-stage injection tube 19 has the function of branching off the refrigerant cooled in the heat source-side heat exchanger 4 or the usage-side heat exchanger 6 and returning the refrigerant to the compression element 2*d* on the second-stage side of the compression mechanism 2. In the present modification, the second-stage injection tube 19 is provided so as to branch off refrigerant flowing through the receiver inlet tube 18*a* and return the refrigerant to the second-stage compression element 2*d*. More specifically, the second-stage injection tube 19 is provided so as to branch off refrigerant from a position upstream of the receiver inlet expansion mechanism 5*a* of the receiver inlet tube 18*a* (specifically, between the heat source-side heat exchanger 4 and the receiver inlet expansion mechanism 5*a* when the switching mechanism 3 is in the cooling operation state, and between the usage-side heat exchanger 6 and the receiver inlet expansion mechanism 5*a* when the switching mechanism 3 is in the heating operation state) and return the refrigerant to a position downstream of the intercooler 7 of the intermediate refrigerant tube 8. The second-stage injection tube 19 is provided with a second-stage injection valve 19*a* whose opening degree can be controlled. The second-stage injection valve 19*a* is an electric expansion valve in the present modification.

The economizer heat exchanger 20 is a heat exchanger for conducting heat exchange between the refrigerant cooled in the heat source-side heat exchanger 4 or the usage-side heat exchanger 6 and the refrigerant flowing through the second-stage injection tube 19 (more specifically, the refrigerant that has been depressurized nearly to an intermediate pressure in the second-stage injection valve 19*a*). In the present modification, the economizer heat exchanger 20 is provided so as to conduct heat exchange between the refrigerant flowing through a position upstream (specifically, between the heat source-side heat exchanger 4 and the receiver inlet expansion mechanism 5*a* when the switching mechanism 3 is in the cooling operation state, and between the usage-side heat exchanger 6 and the receiver inlet expansion mechanism 5*a* when the switching mechanism 3 is in the heating operation state) of the receiver inlet expansion mechanism 5*a* of the receiver inlet tube 18*a* and the refrigerant flowing through the second-stage injection tube 19, and the economizer heat exchanger 20 has flow channels through which both refrigerants flow so as to oppose each other. In the present modification, the economizer heat exchanger 20 is provided upstream of the second-stage injection tube 19 of the receiver inlet tube 18*a*. Therefore, the refrigerant cooled in the heat source-side heat exchanger 4 or usage-side heat exchanger 6 is branched off in the receiver inlet tube 18*a* to the second-stage injection tube 19 before undergoing heat exchange in the economizer heat exchanger 20, and heat exchange is then conducted in the economizer heat exchanger 20 with the refrigerant flowing through the second-stage injection tube 19.

Furthermore, the air-conditioning apparatus 1 of the present modification is provided with various sensors. Specifically, an intermediate pressure sensor 54 for detecting the pressure of refrigerant flowing through the intermediate refrigerant tube 8 is provided to the intermediate refrigerant tube 8 or the compression mechanism 2. The outlet on the second-stage injection tube 19 side of the economizer heat exchanger 20 is provided with an economizer outlet temperature sensor 55 for detecting the temperature of refrigerant at the outlet on the second-stage injection tube 19 side of the economizer heat exchanger 20.

Figure 10:
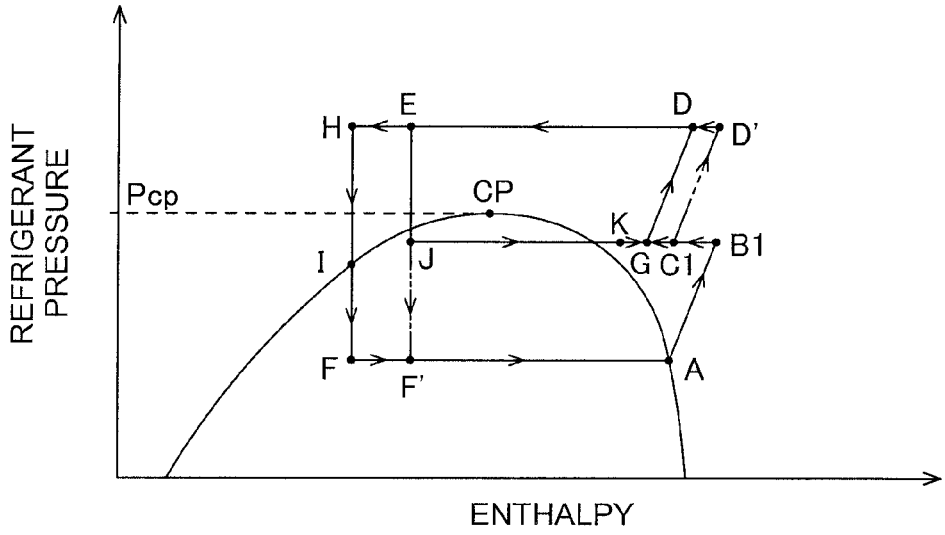
FIG. 10 is a pressure-enthalpy graph representing the refrigeration cycle during the air-cooling operation in the air-conditioning apparatus according to Modification 1.
Figure 11:
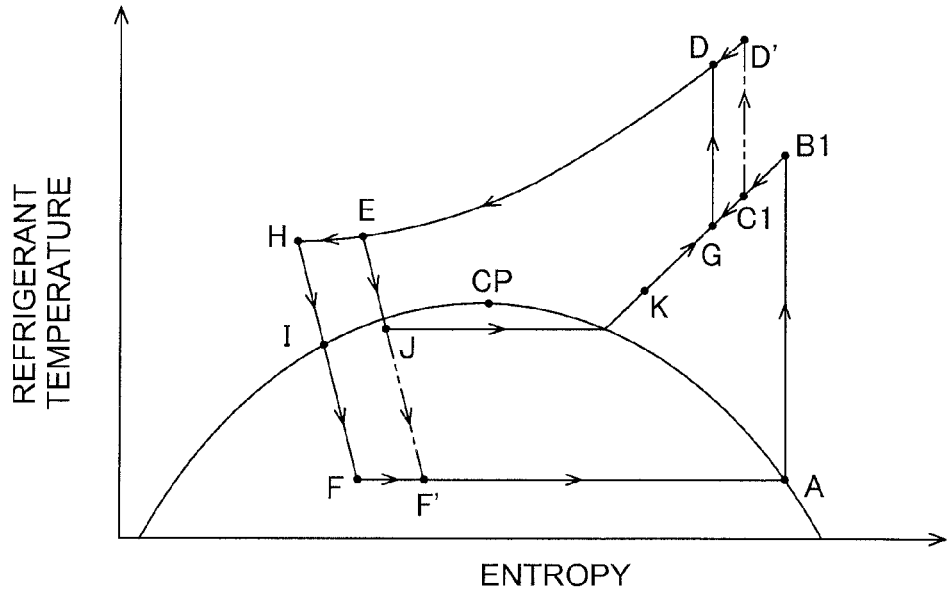
FIG. 11 is a temperature-entropy graph representing the refrigeration cycle during the air-cooling operation in the air-conditioning apparatus according to Modification 1.
Figure 12:
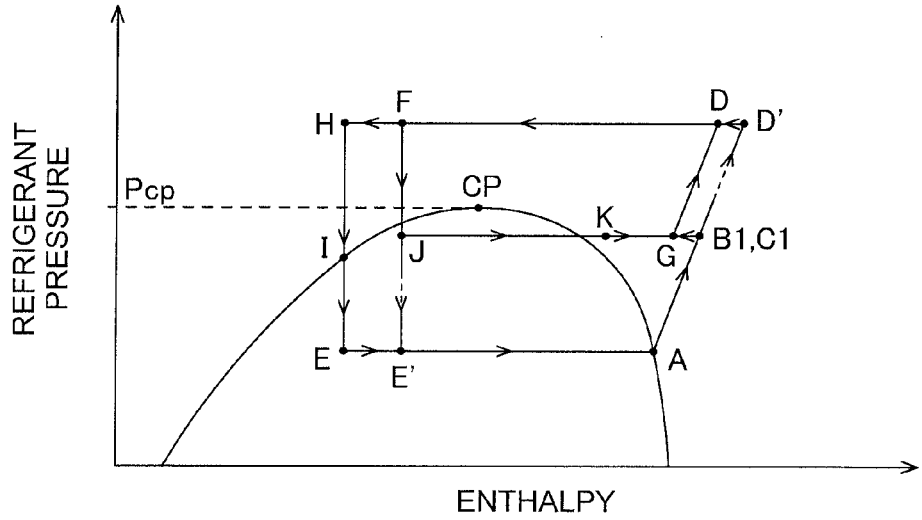
FIG. 12 is a pressure-enthalpy graph representing the refrigeration cycle during the air-warming operation in the air-conditioning apparatus according to Modification 1.
Figure 13:
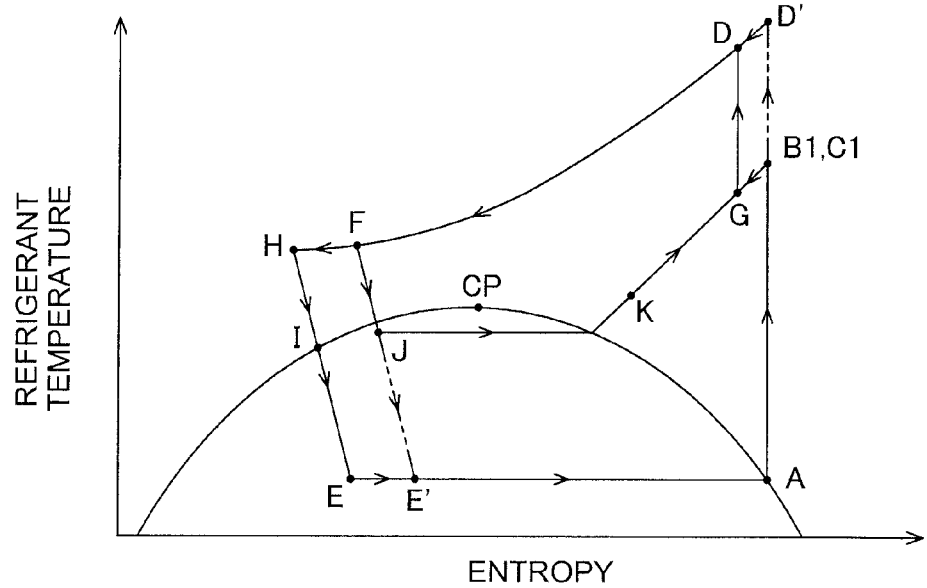
FIG. 13 is a temperature-entropy graph representing the refrigeration cycle during the air-warming operation in the air-conditioning apparatus according to Modification 1.

Next, the action of the air-conditioning apparatus 1 will be described using FIGS. 9 through 13. FIG. 10 is a pressure-enthalpy graph representing the refrigeration cycle during the air-cooling operation in Modification 1, FIG. 11 is a temperature-entropy graph representing the refrigeration cycle during the air-cooling operation in Modification 1, FIG. 12 is a pressure-enthalpy graph representing the refrigeration cycle during the air-warming operation in Modification 1, and FIG. 13 is a temperature-entropy graph representing the refrigeration cycle during the air-warming operation in Modification 1. Operation control in the air-cooling operation, the air-warming operation, and the defrosting operation described hereinbelow is performed by the aforementioned controller (not shown). In the following description, the term "high pressure" means a high pressure in the refrigeration cycle (specifically, the pressure at points D, D', E, and H in FIGS. 10 and 11, and the pressure at points D, D', F, and H in FIGS. 12 and 13), the term "low pressure" means a low pressure in the refrigeration cycle (specifically, the pressure at points A, F, and F' in FIGS. 10 and 11, and the pressure at points A, E, and E' in FIGS. 12 and 13), and the term "intermediate pressure" means an intermediate pressure in the refrigeration cycle (specifically, the pressure at points B1, C1, G, J, and K in FIGS. 10 through 13).

<Air-cooling Operation>

During the air-cooling operation, the switching mechanism 3 is brought to the cooling operation state shown by the solid lines in FIG. 9. The opening degrees of the receiver inlet expansion mechanism 5*a* and the receiver outlet expansion mechanism 5*b* are adjusted. Since the switching mechanism 3 is in the cooling operation state, the cooler on/off valve 12 is opened and the intercooler bypass on/off valve 11 of the intercooler bypass tube 9 is closed, thereby putting the intercooler 7 into a state of functioning as a cooler. Furthermore, the opening degree of the second-stage injection valve 19*a* is also adjusted. More specifically, in the present modification, so-called superheat degree control is performed wherein the opening degree of the second-stage injection valve 19*a* is adjusted so that a target value is achieved in the degree of superheat of the refrigerant at the outlet in the second-stage injection tube 19 side of the economizer heat exchanger 20. In the present modification, the degree of superheat of the refrigerant at the outlet in the second-stage injection tube 19 side of the economizer heat exchanger 20 is obtained by converting the intermediate pressure detected by the intermediate pressure sensor 54 to a saturation temperature and subtracting this refrigerant saturation temperature value from the refrigerant temperature detected by the economizer outlet temperature sensor 55. Though not used in the present embodiment, another possible option is to provide a temperature sensor to the inlet in the second-stage injection tube 19 side of the economizer heat exchanger 20, and to obtain the degree of superheat of the refrigerant at the outlet in the second-stage injection tube 19 side of the economizer heat exchanger 20 by subtracting the refrigerant temperature detected by this temperature sensor from the refrigerant temperature detected by the economizer outlet temperature sensor 55.

When the compression mechanism 2 is driven while the refrigerant circuit 310 is in this state, low-pressure refrigerant (refer to point A in FIGS. 9 to 11) is drawn into the compression mechanism 2 through the intake tube 2*a*, and after the refrigerant is first compressed by the compression element 2*c* to an intermediate pressure, the refrigerant is discharged to the intermediate refrigerant tube 8 (refer to point B1 in FIGS. 9 to 11). The intermediate-pressure refrigerant discharged from the first-stage compression element 2*c* is cooled by heat exchange with air as a cooling source (refer to point C1 in FIGS. 9 to 11). The refrigerant cooled in the intercooler 7 is further cooled (refer to point G in FIGS. 9 to 11) by being mixed with refrigerant being returned from the second-stage injection tube 19 to the compression element 2*d* (refer to point K in FIGS. 9 to 11). Next, having been mixed with the refrigerant returned from the second-stage injection tube 19, the intermediate-pressure refrigerant is drawn into and further compressed in the compression element 2*d* connected to the second-stage side of the compression element 2*c*, and the refrigerant is then discharged from the compression mechanism 2 to the discharge tube 2*b* (refer to point D in FIGS. 9 to 11). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 10). The high-pressure refrigerant discharged from the compression mechanism 2 is fed via the switching mechanism 3 to the heat source-side heat exchanger 4 functioning as a refrigerant cooler, and the refrigerant is cooled by heat exchange with air as a cooling source (refer to point E in FIGS. 9 to 11). The high-pressure refrigerant cooled in the heat source-side heat exchanger 4 flows through the inlet non-return valve 17*a* of the bridge circuit 17 into the receiver inlet tube 18*a*, and some of the refrigerant is branched off to the second-stage injection tube 19. The refrigerant flowing through the second-stage injection tube 19 is depressurized to a nearly intermediate pressure in the second-stage injection valve 19*a* and is then fed to the economizer heat exchanger 20 (refer to point J in FIGS. 9 to 11). The refrigerant flowing through the receiver inlet tube 18*a* after being branched off to the second-stage injection tube 19 then flows into the economizer heat exchanger 20, where it is cooled by heat exchange with the refrigerant flowing through the second-stage injection tube 19 (refer to point H in FIGS. 9 to 11). The refrigerant flowing through the second-stage injection tube 19 is heated by heat exchange with the refrigerant flowing through the receiver inlet tube 18*a* (refer to point K in FIGS. 9 to 11), and this refrigerant is mixed with the refrigerant cooled in the intercooler 7 as described above. The high-pressure refrigerant cooled in the economizer heat exchanger 20 is depressurized to a nearly saturated pressure by the receiver inlet expansion mechanism 5*a* and is temporarily retained in the receiver 18 (refer to point I in FIGS. 9 to 11). The refrigerant retained in the receiver 18 is fed to the receiver outlet tube 18*b* and is depressurized by the receiver outlet expansion mechanism 5*b* to become a low-pressure gas-liquid two-phase refrigerant, and is then fed through the outlet non-return valve 17*c* of the bridge circuit 17 to the usage-side heat exchanger 6 functioning as a refrigerant heater (refer to point F in FIGS. 9 to 11). The low-pressure gas-liquid two-phase refrigerant fed to the usage-side heat exchanger 6 is heated by heat exchange with water or air as a heating source, and the refrigerant is evaporated as a result (refer to point A in FIGS. 9 to 11). The low-pressure refrigerant heated in the usage-side heat exchanger 6 is led once again into the compression mechanism 2 via the switching mechanism 3. In this manner the air-cooling operation is performed.

In the configuration of the present modification, as in the embodiment described above, since the intercooler 7 is in a state of functioning as a cooler during the air-cooling operation in which the switching mechanism 3 is brought to the cooling operation state, heat radiation loss in the heat source-side heat exchanger 4 can be reduced in comparison with cases in which no intercooler 7 is provided.

Moreover, in the configuration of the present modification, since the second-stage injection tube 19 is provided so as to branch off refrigerant fed from the heat source-side heat exchanger 4 to the expansion mechanisms 5*a*, 5*b* and return the refrigerant to the second-stage compression element 2*d*, the temperature of refrigerant drawn into the second-stage compression element 2*d* can be kept even lower (refer to points C1 and G in FIG. 11) without performing heat radiation to the exterior, such as is done with the intercooler 7. The temperature of refrigerant discharged from the compression mechanism 2 is thereby kept even lower (refer to points D and D' in FIG. 11), and operating efficiency can be further improved because heat radiation loss can be further reduced in proportion to the area enclosed by connecting the points C1, D', D, and G in FIG. 11, in comparison with cases in which no second-stage injection tube 19 is provided.

In the configuration of the present modification, since an economizer heat exchanger 20 is also provided for conducting heat exchange between the refrigerant fed from the heat source-side heat exchanger 4 to the expansion mechanisms 5*a*, 5*b* and the refrigerant flowing through the second-stage injection tube 19, the refrigerant fed from the heat source-side heat exchanger 4 to the expansion mechanisms 5*a*, 5*b* can be cooled by the refrigerant flowing through the second-stage injection tube 19 (refer to points E and H in FIGS. 10 and 11), and the cooling capacity per flow rate of refrigerant in the usage-side heat exchanger 6 can be increased in comparison with cases in which the second-stage injection tube 19 and economizer heat exchanger 20 are not provided (in this case, the refrigeration cycle in FIGS. 10 and 11 is performed in the following sequence: point A→point B1→point C1→point D'→point E→point F').

<Air-warming Operation>

During the air-warming operation, the switching mechanism 3 is brought to the heating operation state shown by the dashed lines in FIG. 9. The opening degrees of the receiver inlet expansion mechanism 5*a* and receiver outlet expansion mechanism 5*b* are adjusted. Since the switching mechanism 3 is in the heating operation state, the cooler on/off valve 12 is closed and the intercooler bypass on/off valve 11 of the intercooler bypass tube 9 is opened, thereby putting the intercooler 7 in a state of not functioning as a cooler. Furthermore, the opening degree of the second-stage injection valve 19*a* is also adjusted by the same superheat degree control as in the air-cooling operation.

When the compression mechanism 2 is driven while the refrigerant circuit 310 is in this state, low-pressure refrigerant (refer to point A in FIGS. 9, 12, and 13) is drawn into the compression mechanism 2 through the intake tube 2*a*, and after the refrigerant is first compressed by the compression element 2*c* to an intermediate pressure, the refrigerant is discharged to the intermediate refrigerant tube 8 (refer to point B1 in FIGS. 9, 12, and 13). Unlike the air-cooling operation, the intermediate-pressure refrigerant discharged from the first-stage compression element 2*c* passes through the intercooler bypass tube 9 (refer to point C1 in FIGS. 9, 12, and 13) without passing through the intercooler 7 (i.e. without being cooled), and the refrigerant is cooled (refer to point G in FIGS. 9, 12, and 13) by being mixed with refrigerant being returned from the second-stage injection tube 19 to the second-stage compression element 2*d* (refer to point K in FIGS. 9, 12, and 13). Next, having been mixed with the refrigerant returning from the second-stage injection tube 19, the intermediate-pressure refrigerant is led to and further compressed in the compression element 2*d* connected to the second-stage side of the compression element 2*c*, and the refrigerant is discharged from the compression mechanism 2 to the discharge tube 2*b* (refer to point D in FIGS. 9, 12, and 13). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 12), similar to the air-cooling operation. The high-pressure refrigerant discharged from the compression mechanism 2 is fed via the switching mechanism 3 to the usage-side heat exchanger 6 functioning as a refrigerant cooler, and the refrigerant is cooled by heat exchange with water or air as a cooling source (refer to point F in FIGS. 9, 12, and 13). The high-pressure refrigerant cooled in the usage-side heat exchanger 6 flows through the inlet non-return valve 17*b* of the bridge circuit 17 into the receiver inlet tube 18*a*, and some of the refrigerant is branched off to the second-stage injection tube 19. The refrigerant flowing through the second-stage injection tube 19 is depressurized to a nearly intermediate pressure in the second-stage injection valve 19*a*, and is then fed to the economizer heat exchanger 20 (refer to point J in FIGS. 9, 12, and 13). The refrigerant flowing through the receiver inlet tube 18*a* after being branched off to the second-stage injection tube 19 then flows into the economizer heat exchanger 20 and is cooled by heat exchange with the refrigerant flowing through the second-stage injection tube 19 (refer to point H in FIGS. 9, 12, and 13). The refrigerant flowing through the second-stage injection tube 19 is heated by heat exchange with the refrigerant flowing through the receiver inlet tube 18*a* (refer to point K in FIGS. 9, 12, and 13), and the refrigerant is mixed with the intermediate-pressure refrigerant discharged from the first-stage compression element 2*c* as described above. The high-pressure refrigerant cooled in the economizer heat exchanger 20 is depressurized to a nearly saturated pressure by the receiver inlet expansion mechanism 5*a* and is temporarily retained in the receiver 18 (refer to point I in FIGS. 9, 12, and 13). The refrigerant retained in the receiver 18 is fed to the receiver outlet tube 18*b* and is depressurized by the receiver outlet expansion mechanism 5*b* to become a low-pressure gas-liquid two-phase refrigerant, and is then fed through the outlet non-return valve 17*d* of the bridge circuit 17 to the heat source-side heat exchanger 4 functioning as a refrigerant heater (refer to point E in FIGS. 9, 12, and 13). The low-pressure gas-liquid two-phase refrigerant fed to the heat source-side heat exchanger 4 is heated by heat exchange with air as a heating source, and the refrigerant is evaporated as a result (refer to point A in FIGS. 9, 12, and 13). The low-pressure refrigerant heated in the heat source-side heat exchanger 4 is led once again into the compression mechanism 2 via the switching mechanism 3. In this manner the air-warming operation is performed.

In the configuration of the present modification, as in the embodiment described above, since the intercooler 7 is in a state of not functioning as a cooler during the air-warming operation in which the switching mechanism 3 is in the heating operation state, it is possible to minimize heat radiation to the exterior and minimize the decrease in temperature of the refrigerant supplied to the usage-side heat exchanger 6 functioning as a refrigerant cooler, loss of heating capacity can be minimized, and loss of operating efficiency can be prevented, in comparison with cases in which only the intercooler 7 or cases in which the intercooler 7 is made to function as a cooler as in the air-cooling operation described above.

Moreover, in the configuration of the present modification, since the second-stage injection tube 19 is provided so as to branch off refrigerant fed from the usage-side heat exchanger 6 to the expansion mechanisms 5*a*, 5*b* and return the refrigerant to the second-stage compression element 2*d*, the temperature of the refrigerant discharged from the compression mechanism 2 is lower (refer to points D and D' in FIG. 13), and the heating capacity per flow rate of refrigerant in the usage-side heat exchanger 6 thereby decreases (refer to points D, D', and F in FIG. 12), but since the flow rate of refrigerant discharged from the second-stage compression element 2*d* increases, the heating capacity in the usage-side heat exchanger 6 is preserved, and operating efficiency can be improved.

In the configuration of the present modification, since an economizer heat exchanger 20 is also provided for conducting heat exchange between the refrigerant fed from the usage-side heat exchanger 6 to the expansion mechanisms 5*a*, 5*b* and the refrigerant flowing through the second-stage injection tube 19, the refrigerant flowing through the second-stage injection tube 19 can be heated by the refrigerant fed from the usage-side heat exchanger 6 to the expansion mechanisms 5*a*, 5*b* (refer to points J and K in FIGS. 12 and 13), and the flow rate of refrigerant discharged from the second-stage compression element 2*d* can be increased in comparison with cases in which the second-stage injection tube 19 and economizer heat exchanger 20 are not provided (in this case, the refrigeration cycle in FIGS. 12 and 13 is performed in the following sequence: point A→point B1→point C1→point D'→point F→point E').

Advantages of both the air-cooling operation and the air-warming operation in the configuration of the present modification are that the economizer heat exchanger 20 is a heat exchanger which has flow channels through which refrigerant fed from the heat source-side heat exchanger 4 or usage-side heat exchanger 6 to the expansion mechanisms 5*a*, 5*b* and refrigerant flowing through the second-stage injection tube 19 both flow so as to oppose each other; therefore, it is possible to reduce the temperature difference between the refrigerant fed to the expansion mechanisms 5*a*, 5*b* from the heat source-side heat exchanger 4 or the usage-side heat exchanger 6 in the economizer heat exchanger 20 and the refrigerant flowing through the second-stage injection tube 19, and high heat exchange efficiency can be achieved. In the configuration of the present modification, since the second-stage injection tube 19 is provided so as to branch off the refrigerant fed to the expansion mechanisms 5*a*, 5*b* from the heat source-side heat exchanger 4 or the usage-side heat exchanger 6 before the refrigerant fed to the expansion mechanisms 5*a*, 5*b* from the heat source-side heat exchanger 4 or the usage-side heat exchanger 6 undergoes heat exchange in the economizer heat exchanger 20, it is possible to reduce the flow rate of the refrigerant fed from the heat source-side heat exchanger 4 or usage-side heat exchanger 6 to the expansion mechanisms 5*a*, 5*b* and subjected to heat exchange with the refrigerant flowing through the second-stage injection tube 19 in the economizer heat exchanger 20, the quantity of heat exchanged in the economizer heat exchanger 20 can be reduced, and the size of the economizer heat exchanger 20 can be reduced.

<Defrosting Operation>

In the air-conditioning apparatus 1, when the air-warming operation is performed while there is a low temperature in the air used as the heat source of the heat source-side heat exchanger 4, there is a danger that frost deposits will form in the heat source-side heat exchanger 4 functioning as a refrigerant heater similar to the embodiment described above, thereby reducing the heat transfer performance of the heat source-side heat exchanger 4. Defrosting of the heat source-side heat exchanger 4 must therefore be performed.

The defrosting operation of the present modification is described in detail hereinbelow using FIGS. 6, 14, and 15.

First, in step S1, a determination is made as to whether or not frost deposits have formed in the heat source-side heat exchanger 4 during the air-warming operation. This determination is the same as that of the embodiment described above and is therefore not described herein.

Next, in step S2, the defrosting operation is started. This defrosting operation is an operation wherein, similar to the embodiment described above, the heat source-side heat exchanger 4 is made to function as a refrigerant cooler by switching the switching mechanism 3 from the heating operation state (i.e. the air-warming operation) to the cooling operation state (i.e. the air-cooling operation), and the intercooler 7 is made to function as a cooler by opening the cooler on/off valve 12 and closing the intercooler bypass on/off valve 11.

When the reverse cycle defrosting operation is used, there is a problem with a decrease in the temperature on the usage side because the usage-side heat exchanger 6 is made to function as a refrigerant heater, regardless of whether the usage-side heat exchanger 6 is intended to function as a refrigerant cooler. Since the reverse cycle defrosting operation is an air-cooling operation performed under conditions of a low temperature in the air as the heat source, the low pressure of the refrigeration cycle decreases, and the flow rate of refrigerant drawn in from the first-stage compression element 2*c* is reduced. When this happens, another problem emerges that more time is required for defrosting the heat source-side heat exchanger 4 because the flow rate of refrigerant circulated through the refrigerant circuit 310 is reduced and the flow rate of refrigerant flowing through the heat source-side heat exchanger 4 can no longer be guaranteed.

Figure 14:
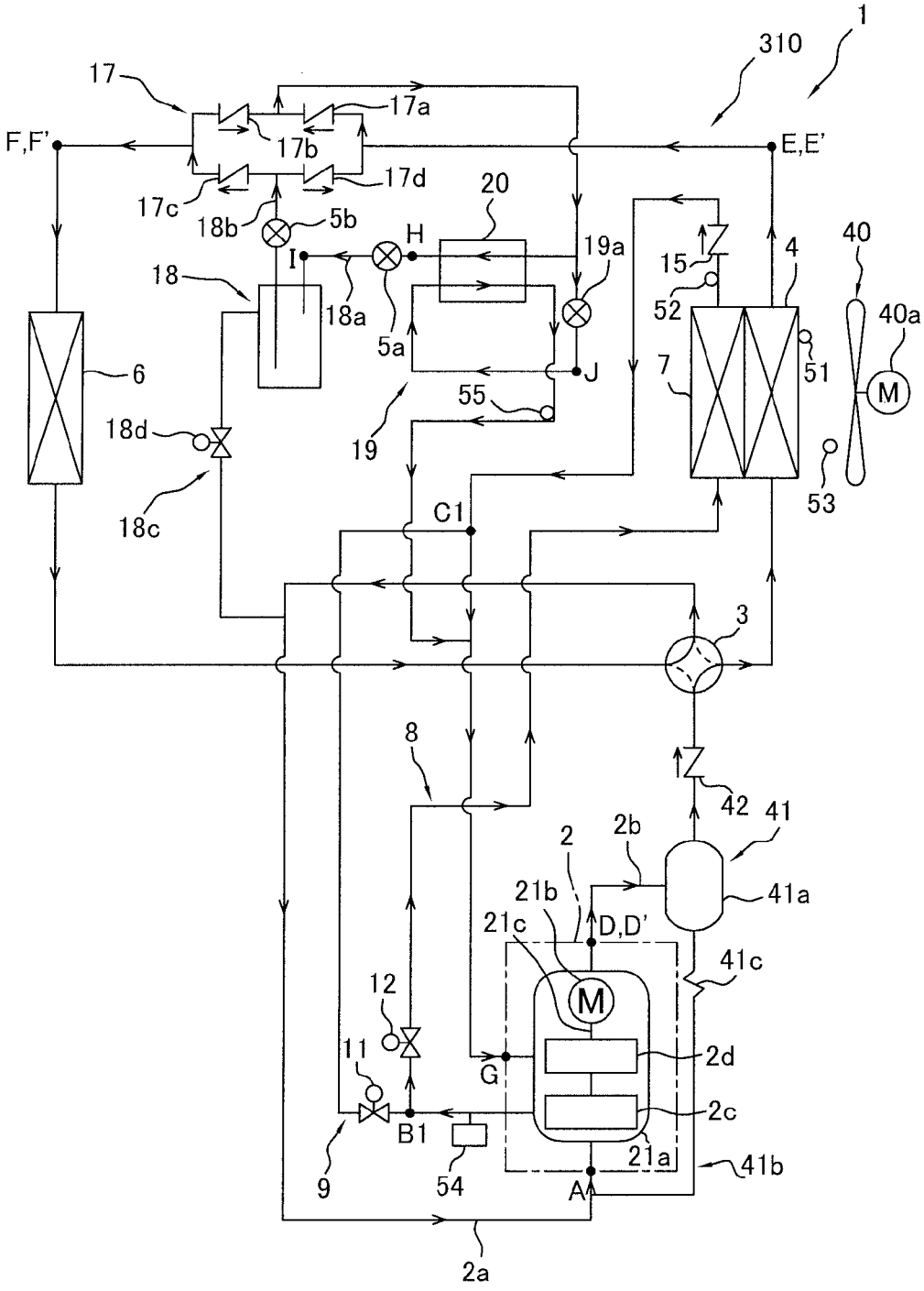
FIG. 14 is a diagram showing the flow of refrigerant within the air-conditioning apparatus at the start of the defrosting operation according to Modification 1.
Figure 15:
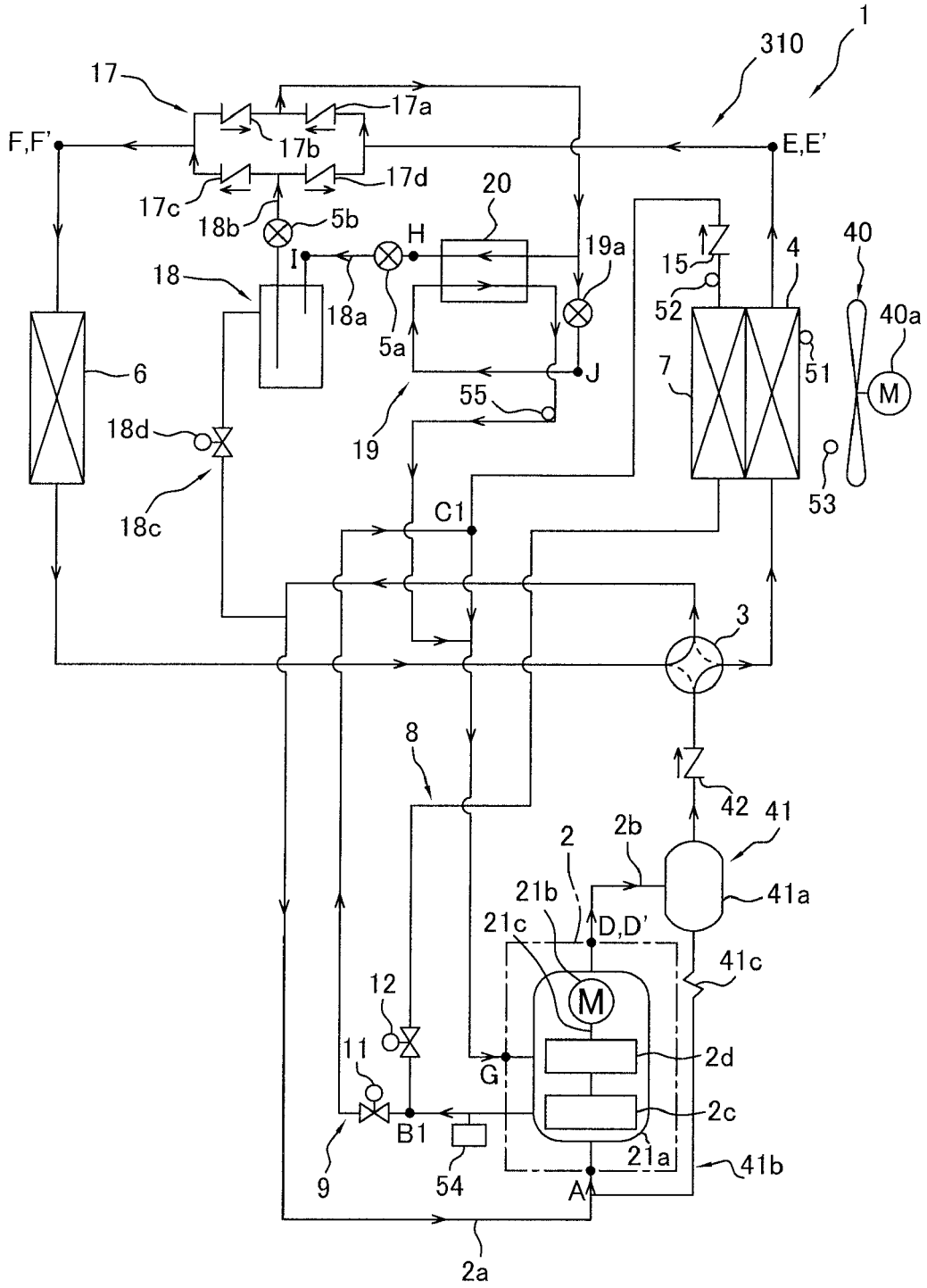
FIG. 15 is a diagram showing the flow of refrigerant within the air-conditioning apparatus after defrosting of the intercooler is complete in the defrosting operation according to Modification 1.

In view of this, in the present modification, the second-stage injection tube 19 is used to perform a reverse cycle defrosting operation while the refrigerant fed from the heat source-side heat exchanger 4 to the usage-side heat exchanger 6 is being returned to the second-stage compression element 2*d* (refer to the arrows indicating the flow of refrigerant in FIG. 14). Moreover, in the present modification, a control is performed so that the opening degree of the second-stage injection valve 19*a* is opened greater than the opening degree of the second-stage injection valve 19*a* during the air-warming operation immediately before the reverse cycle defrosting operation. In a case in which the opening degree of the second-stage injection valve 19*a* when fully closed is 0%, the opening degree when fully open is 100%, and the second-stage injection valve 19*a* is controlled during the air-warming operation within the opening-degree range of 50% or less, for example; the second-stage injection valve 19*a* in step S2 is controlled so that the opening degree increases up to about 70%, and this opening degree is kept constant until it is determined in step S5 that defrosting of the heat source-side heat exchanger 4 is complete.

Defrosting of the intercooler 7 is thereby performed, and a reverse cycle defrosting operation is achieved in which the flow rate of refrigerant flowing through the second-stage injection tube 19 is increased, the flow rate of refrigerant flowing through the usage-side heat exchanger 6 is reduced, the flow rate of refrigerant processed in the second-stage compression element 2*d* is increased, and a flow rate of refrigerant flowing through the heat source-side heat exchanger 4 can be guaranteed. Moreover, in the present modification, since the control is performed so that the opening degree of the second-stage injection valve 19*a* is opened greater than the opening degree during the air-warming operation immediately before the reverse cycle defrosting operation, it is possible to further increase the flow rate of refrigerant flowing through the heat source-side heat exchanger 4 while further reducing the flow rate of refrigerant flowing through the usage-side heat exchanger 6.

Next, in step S3, a determination is made as to whether or not defrosting of the intercooler 7 is complete, and in cases in which defrosting of the intercooler 7 is determined to be complete, the process advances to step S4. This determination is the same as in the embodiment described above and is therefore not described herein.

Next, the process transitions in step S4 from an operation of defrosting the intercooler 7 and the heat source-side heat exchanger 4 to an operation of defrosting only the heat source-side heat exchanger 4. In step S4, similar to the embodiment described above, while defrosting of the heat source-side heat exchanger 4 is continued through the reverse cycle defrosting operation, an operation is performed to ensure that the intercooler 7 does not function as a cooler by closing the cooler on/off valve 12 and opening the intercooler bypass on/off valve 11 (refer to the arrows indicating the flow of refrigerant in FIG. 15). In step S4, the second-stage injection tube 19 is used to continually perform the action of returning the refrigerant fed from the heat source-side heat exchanger 4 to the usage-side heat exchanger 6 back to the second-stage compression element 2*d*. Heat radiation from the intercooler 7 to the exterior thereby does not take place, the decrease in the temperature of the refrigerant drawn into the second-stage compression element 2*d* is therefore minimized, and as a result, the decrease in the temperature of the refrigerant discharged from the compression mechanism 2 can be minimized, and the decrease in the defrosting capacity of the heat source-side heat exchanger 4 can be minimized.

Next, a determination is made in step S5 as to whether or not defrosting of the heat source-side heat exchanger 4 is complete, and in cases in which defrosting of the heat source-side heat exchanger 4 is determined to be complete, the process transitions to step S6, the defrosting operation is ended, and a process for restarting the air-warming operation is performed. This determination is the same as the embodiment described above and is therefore not described herein.

In the present modification, as with the embodiment described above, when the defrosting operation is being performed, the intercooler 7 can be defrosted as well, and the decrease in defrosting capacity resulting from heat radiation from the intercooler 7 to the exterior can be minimized, which can contribute to reducing the defrosting time.

Moreover, in the present modification, the second-stage injection tube 19 is used to perform the action of returning the refrigerant fed from the heat source-side heat exchanger 4 to the usage-side heat exchanger 6 back to the second-stage compression element 2*d*, whereby the temperature decrease on the usage side during the reverse cycle defrosting operation can be minimized, and the defrosting time of the heat source-side heat exchanger 4 can be reduced.

In the present modification, since the second-stage injection tube 19 is provided so as to branch off refrigerant from between the heat source-side heat exchanger 4 and the expansion mechanism (in this case, the receiver inlet expansion mechanism 5*a* for depressurizing the high-pressure refrigerant cooled in the heat source-side heat exchanger 4 before the refrigerant is fed to the usage-side heat exchanger 6) when the switching mechanism 3 is set to the cooling operation state, it is possible to use the pressure difference between the pressure prior to depressurizing by the expansion mechanism and the pressure in the intake side of the second-stage compression element 2*d*, it becomes easier to increase the flow rate of refrigerant returned to the second-stage compression element 2*d*, the flow rate of refrigerant flowing through the usage-side heat exchanger 6 can be further reduced, and the flow rate of refrigerant flowing through the heat source-side heat exchanger 4 can be further increased.

In the present modification, since an economizer heat exchanger 20 is also provided for conducting heat exchange between the refrigerant flowing through the second-stage injection tube 19 and the refrigerant fed from the heat source-side heat exchanger 4 to the expansion mechanism (in this case, the receiver inlet expansion mechanism 5*a* for depressurizing the high-pressure refrigerant cooled in the heat source-side heat exchanger 4 before the refrigerant is fed to the usage-side heat exchanger 6) when the switching mechanism 3 is set to the cooling operation state, there is less danger that the refrigerant flowing through the second-stage injection tube 19 will be heated by heat exchange with the refrigerant flowing from the heat source-side heat exchanger 4 to the expansion mechanism, and that the refrigerant drawn into the second-stage compression element 2*d* will become wet. The flow rate of refrigerant returned to the second-stage compression element 2*d* is more readily increased, the flow rate of refrigerant flowing through the usage-side heat exchanger 6 can be further reduced, and the flow rate of refrigerant flowing through the heat source-side heat exchanger 4 can be further increased.

(4) Modification 2

In the defrosting operation in Modification 1 described above, although only temporarily until defrosting of the intercooler 7 is complete, the refrigerant flowing through the intercooler 7 condenses and the refrigerant drawn into the compression element 2*d* becomes wet, presenting a risk that wet compression will occur in the second-stage compression element 2*d* and the compression mechanism 2 will be overloaded.

Figure 16:
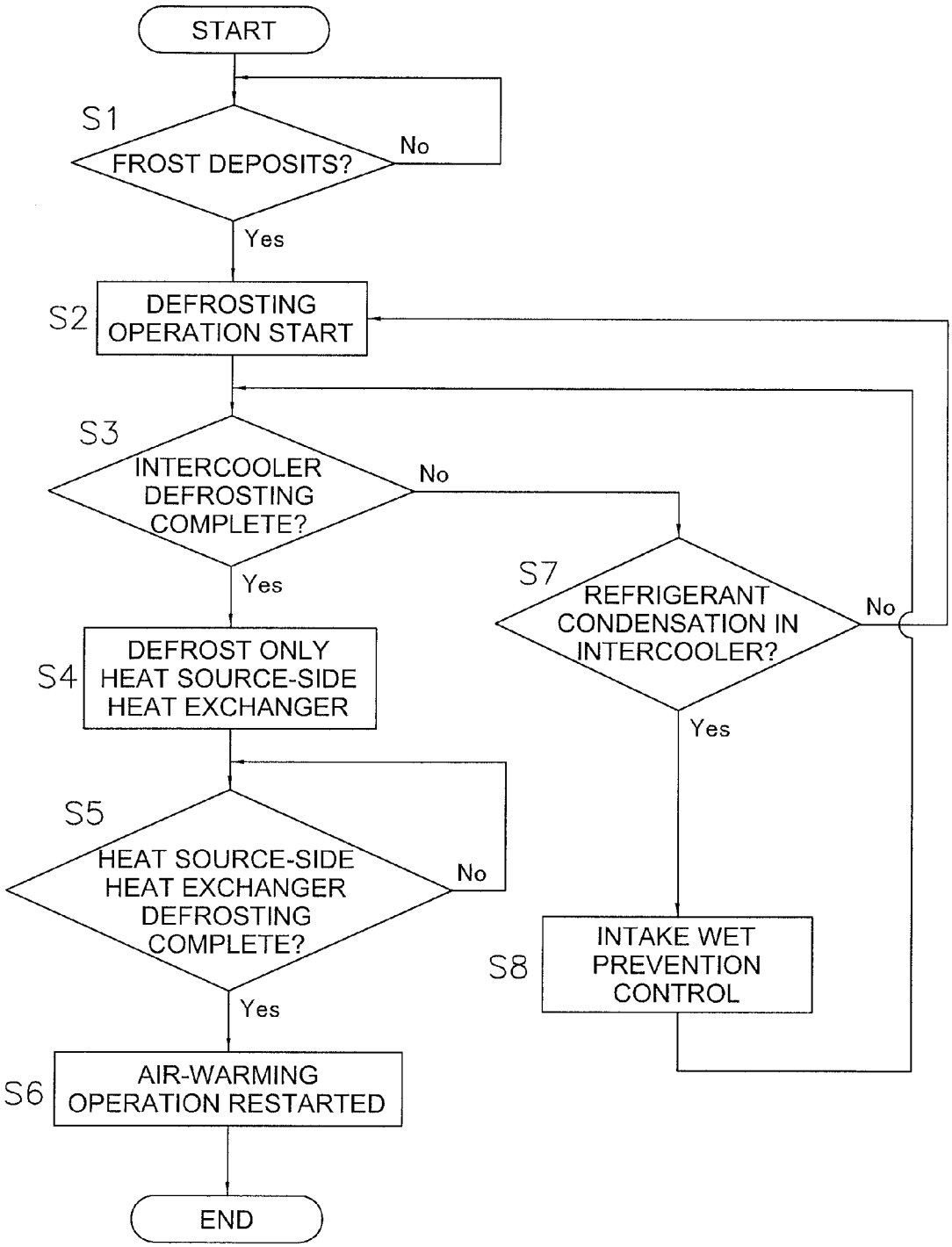
FIG. 16 is a flowchart of the defrosting operation according to Modification 2.

In view of this, in the present modification, as shown in FIG. 16, in cases in which it is detected in step S7 that the refrigerant has condensed in the refrigerant flowing through the intercooler 7, intake wet prevention control is performed in step S8 for reducing the flow rate of refrigerant returned to the second-stage compression element 2*d* via the second-stage injection tube 19.

The decision of whether or not the refrigerant has condensed in the refrigerant flowing through the intercooler 7 in step S7 is based on the degree of superheat of refrigerant at the outlet of the refrigerant flowing through the intercooler 7. For example, in cases in which the degree of superheat of refrigerant at the outlet of the refrigerant flowing through the intercooler 7 is detected as being zero or less (i.e. a state of saturation), it is determined that refrigerant has condensed in the refrigerant flowing through the intercooler 7, and in cases in which such superheat degree conditions are not met, it is determined that refrigerant has not condensed in the refrigerant flowing through the intercooler 7. The degree of superheat of the refrigerant at the outlet of the refrigerant flowing through the intercooler 7 is found by subtracting a saturation temperature obtained by converting the pressure of the refrigerant flowing through the intermediate refrigerant tube 8 as detected by the intermediate pressure sensor 54, from the temperature of the refrigerant at the outlet of the refrigerant flowing through the intercooler 7 as detected by the intercooler outlet temperature sensor 52.

Figure 17:
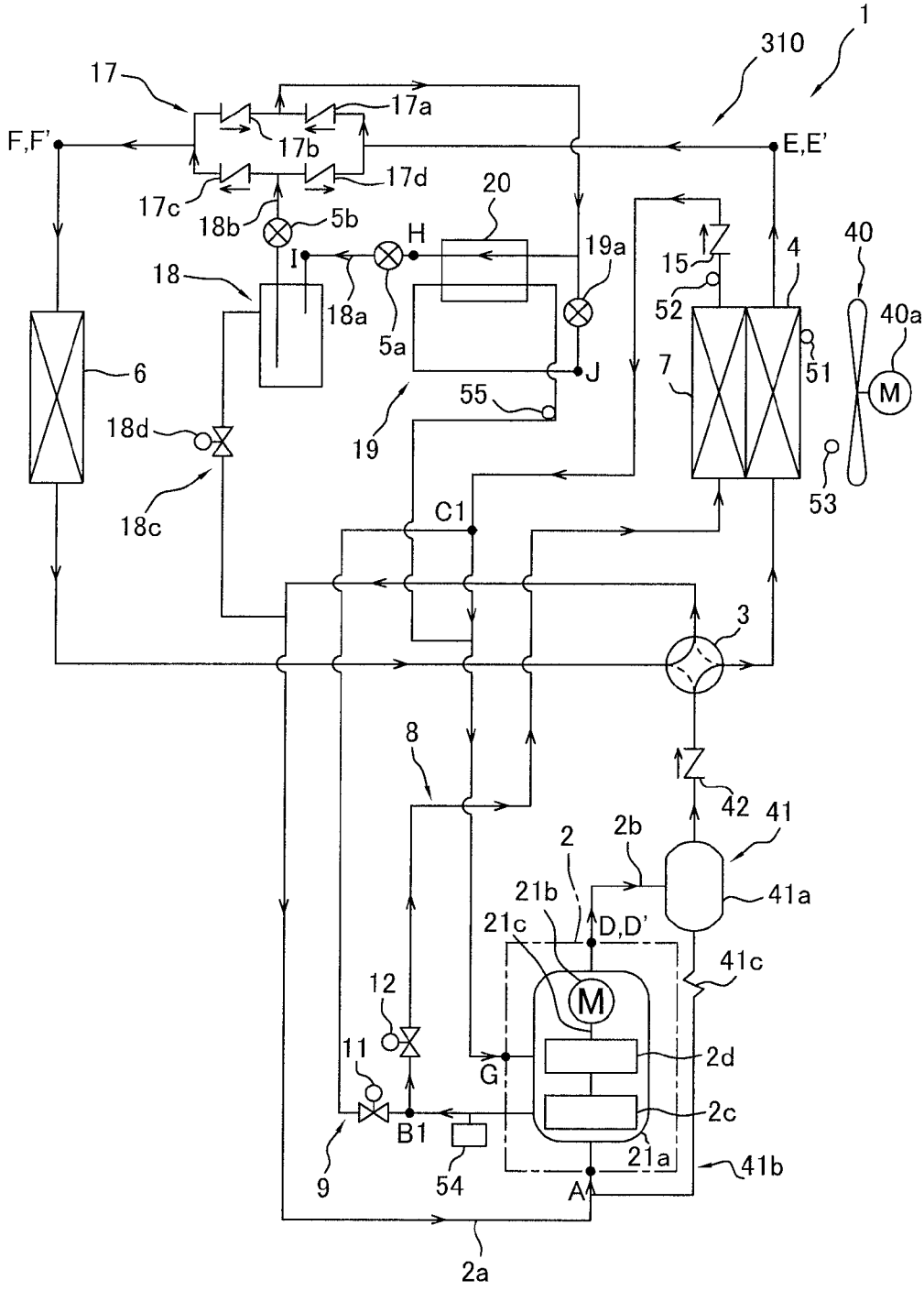
FIG. 17 is a diagram showing the flow of refrigerant within an air-conditioning apparatus when the refrigerant has condensed in the intercooler in the defrosting operation according to Modification 2.

In step S8, the opening degree of the second-stage injection valve 19*a* is controlled so as to decrease, thereby reducing the flow rate of refrigerant returned to the second-stage compression element 2*d* via the second-stage injection tube 19, but in the present modification, a control is performed so that the opening degree (e.g. nearly fully closed) is less than the opening degree (about 70% in this case) prior to the detection of refrigerant condensation in the refrigerant flowing through the intercooler 7 (refer to the arrows indicating the flow of refrigerant in FIG. 17).

In view of this, in the present modification, in addition to the effects in Modification 1 described above, even in cases in which the refrigerant flowing through the intercooler 7 has condensed before defrosting of the refrigerant flowing through the intercooler 7 is complete, the flow rate of refrigerant returned to the second-stage compression element 2*d* via the second-stage injection tube 19 is temporarily reduced, whereby the degree of wet in the refrigerant drawn into the second-stage compression element 2*d* can be suppressed while defrosting of the refrigerant flowing through the intercooler 7 continues, and it is possible to suppress the occurrence of wet compression in the second-stage compression element 2*d* as well as overloading of the compression mechanism 2.

(5) Modification 3

In the defrosting operation in Modifications 1 and 2 described above, after it has been detected that defrosting of the intercooler 7 is complete, the operation is performed to ensure that the intercooler 7 does not function as a cooler by closing the cooler on/off valve 12 and opening the intercooler bypass on/off valve 11 while the heat source-side heat exchanger 4 continues to be defrosted by the reverse cycle defrosting operation, heat radiation from the intercooler 7 to the exterior is prevented, and the decrease in defrosting capacity of the heat source-side heat exchanger 4 can be minimized.

However, when refrigerant does not flow to the intercooler 7, the temperature of the refrigerant drawn into the second-stage compression element 2*d* suddenly increases; therefore, there is a tendency for the refrigerant drawn into the second-stage compression element 2*d* to become less dense and for the flow rate of refrigerant drawn into the second-stage compression element 2*d* to decrease. Therefore, a danger arises that the effects of minimizing the loss of defrosting capacity of the heat source-side heat exchanger 4 will not be adequately obtained, due to the balance between the action of increasing the defrosting capacity by preventing heat radiation from the intercooler 7 to the exterior, and the action of reducing the defrosting capacity by reducing the flow rate of refrigerant flowing through the heat source-side heat exchanger 4.

In view of this, in step S4 in the present modification, the intercooler bypass tube 9 is used to ensure that refrigerant does not flow to the intercooler 7, the opening degree of the second-stage injection valve 19*a* is controlled so as to increase, whereby heat radiation from the intercooler 7 to the exterior is prevented, the refrigerant fed from the heat source-side heat exchanger 4 to the usage-side heat exchanger 6 is returned to the second-stage compression element 2*d*, and the flow rate of refrigerant flowing through the heat source-side heat exchanger 4 is increased. In step S2, the opening degree of the second-stage injection valve 19*a* is greater (about 70% in this case) than the opening degree of the second-stage injection valve 19*a* during the air-warming operation immediately prior to the reverse cycle defrosting operation, but in step S4, a control is performed for opening the valve to an even larger opening degree (e.g. nearly fully open).

In the present modification, after defrosting of the intercooler 7 is complete, heat radiation from the intercooler 7 to the exterior is prevented, the refrigerant fed from the heat source-side heat exchanger 4 to the usage-side heat exchanger 6 is returned to the second-stage compression element 2*d*, the flow rate of refrigerant flowing through the heat source-side heat exchanger 4 is increased, and the loss of defrosting capacity of the heat source-side heat exchanger 4 is minimized. Moreover, the flow rate of refrigerant flowing through the usage-side heat exchanger 6 can be reduced.

In the present modification, it is thereby possible to minimize the loss of defrosting capacity when the reverse cycle defrosting operation is being performed, in addition to the effects in Modifications 1 and 2 described above. It is also possible to minimize the temperature decrease on the usage side during the reverse cycle defrosting operation.

(6) Modification 4

Figure 18:
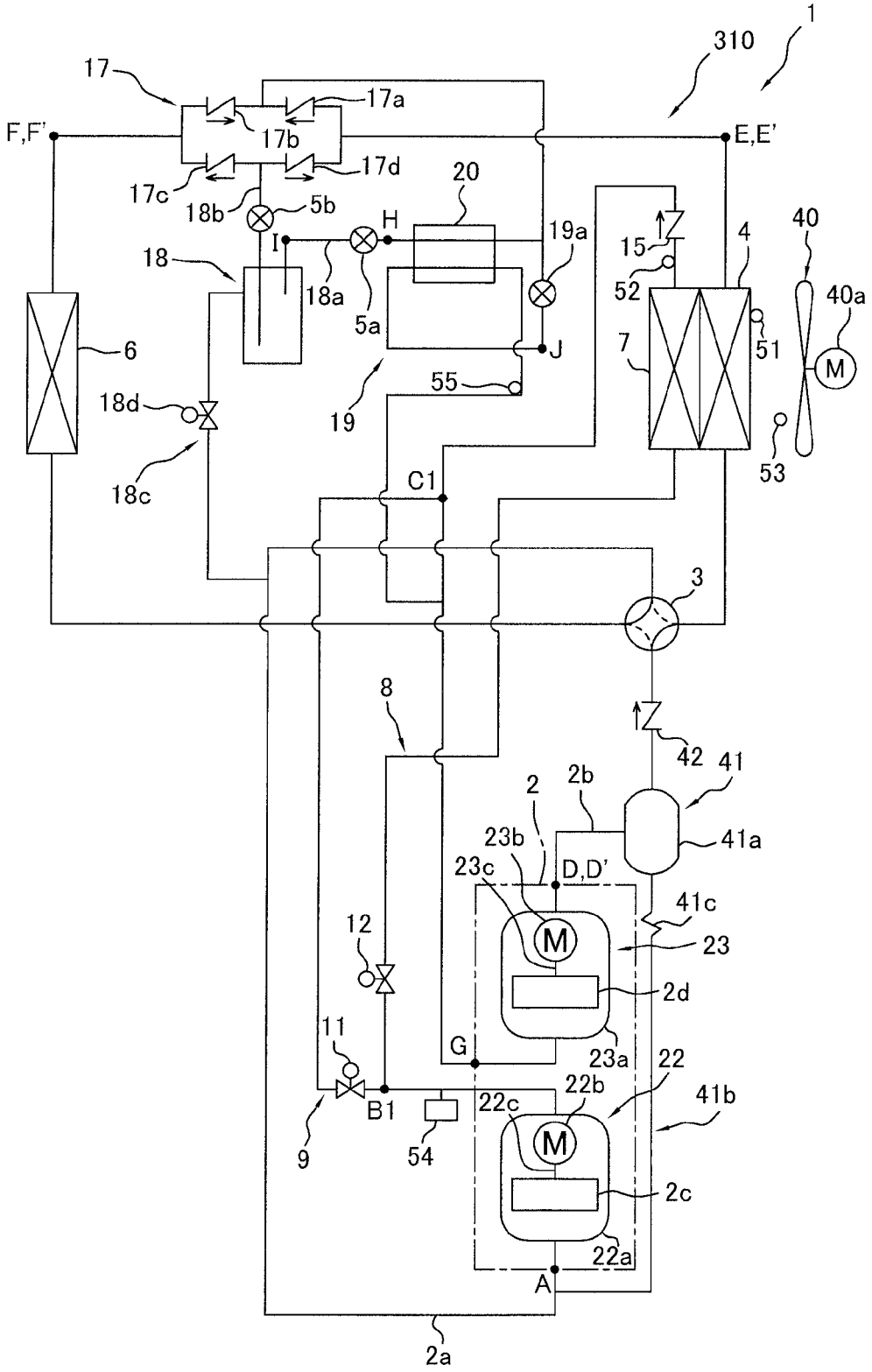
FIG. 18 is a schematic structural diagram of an air-conditioning apparatus according to Modification 4.

In the above-described embodiment and modifications thereof, a two-stage compression-type compression mechanism 2 is configured from the single compressor 21 having a single-shaft two-stage compression structure, wherein two compression elements 2*c*, 2*d* are provided and refrigerant discharged from the first-stage compression element is sequentially compressed in the second-stage compression element, but another possible option is to configure a compression mechanism 2 having a two-stage compression structure by connecting two compressors in series, each of which compressors having a single-stage compression structure in which one compression element is rotatably driven by one compressor drive motor, as shown in FIG. 18, for example.

The compression mechanism 2 has a compressor 22 and a compressor 23. The compressor 22 has a hermetic structure in which a casing 22*a* houses a compressor drive motor 22*b*, a drive shaft 22*c*, and a compression element 2*c*. The compressor drive motor 22*b* is coupled with the drive shaft 22*c*, and the drive shaft 22*c* is coupled with the compression element 2*c*. The compressor 23 has a hermetic structure in which a casing 23*a* houses a compressor drive motor 23*b*, a drive shaft 23*c*, and a compression element 2*d*. The compressor drive motor 23*b* is coupled with the drive shaft 23*c*, and the drive shaft 23*c* is coupled with the compression element 2*d*. As in the above-described embodiment and modifications thereof, the compression mechanism 2 is configured so as to admit refrigerant through an intake tube 2*a*, discharge the drawn-in refrigerant to an intermediate refrigerant tube 8 after the refrigerant has been compressed by the compression element 2*c*, and discharge the refrigerant discharged to a discharge tube 2*b* after the refrigerant has been drawn into the compression element 2*d* and further compressed.

Figure 19:
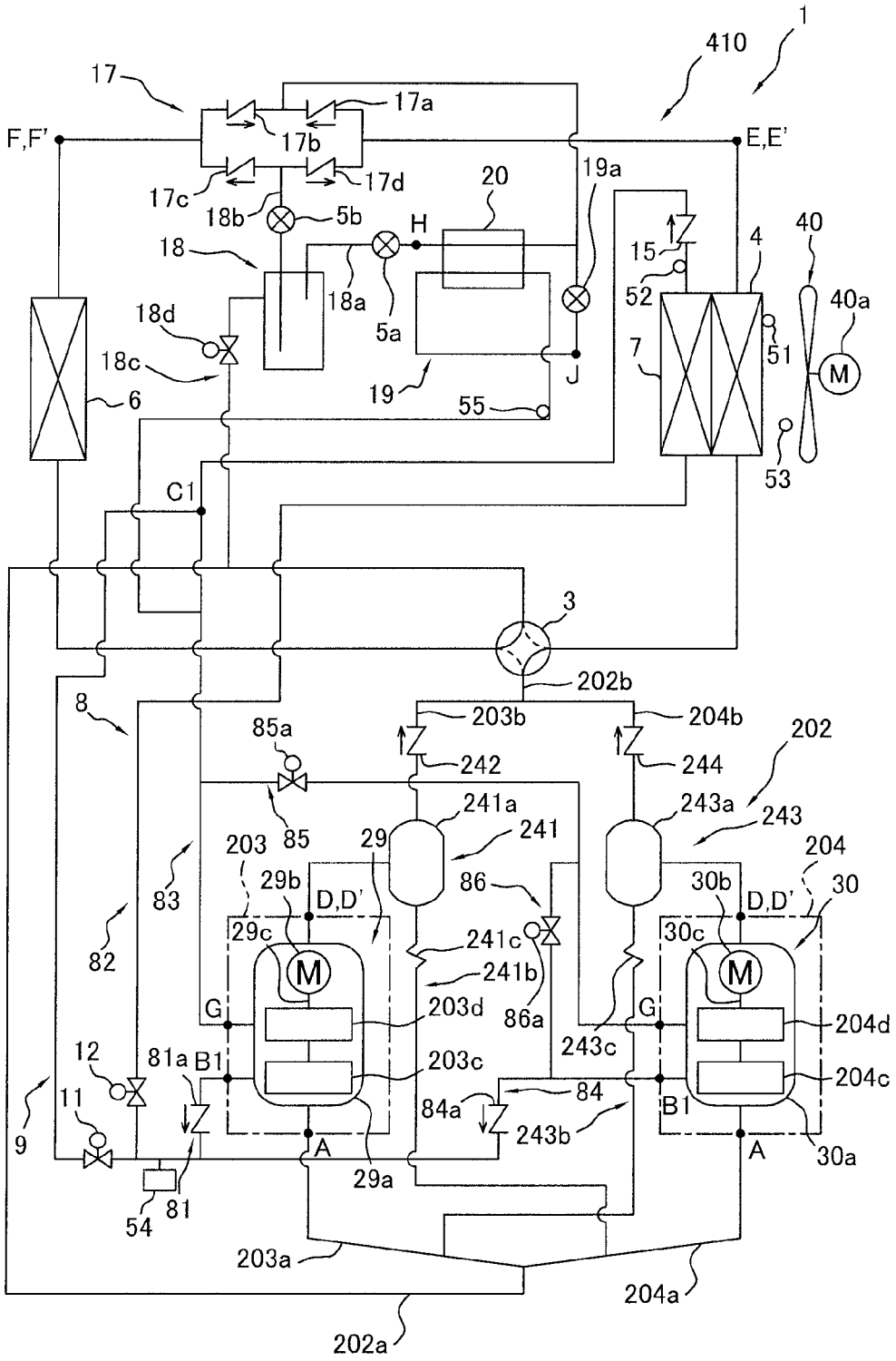
FIG. 19 is a schematic structural diagram of an air-conditioning apparatus according to Modification 4.

A refrigerant circuit 410 may be used which uses a compression mechanism 202 having two-stage compression-type compression mechanisms 203, 204 instead of the two-stage compression-type compression mechanism 2, as shown in FIG. 19, for example.

In the present modification, the first compression mechanism 203 is configured using a compressor 29 for subjecting the refrigerant to two-stage compression through two compression elements 203*c*, 203*d*, and is connected to a first intake branch tube 203*a* which branches off from an intake header tube 202*a* of the compression mechanism 202, and also to a first discharge branch tube 203*b* whose flow merges with a discharge header tube 202*b* of the compression mechanism 202. In the present modification, the second compression mechanism 204 is configured using a compressor 30 for subjecting the refrigerant to two-stage compression through two compression elements 204*c*, 204*d*, and is connected to a second intake branch tube 204*a* which branches off from the intake header tube 202*a* of the compression mechanism 202, and also to a second discharge branch tube 204*b* whose flow merges with the discharge header tube 202*b* of the compression mechanism 202. Since the compressors 29, 30 have the same configuration as the compressor 21 in the embodiment described above, symbols indicating components other than the compression elements 203*c*, 203*d*, 204*c*, 204*d* are replaced with symbols beginning with 29 or 30, and these components are not described. The compressor 29 is configured so that refrigerant is drawn in through the first intake branch tube 203*a*, the drawn-in refrigerant is compressed by the compression element 203*c* and then discharged to a first inlet-side intermediate branch tube 81 constituting the intermediate refrigerant tube 8, the refrigerant discharged to the first inlet-side intermediate branch tube 81 is drawn in into the compression element 203*d* via an intermediate header tube 82 and a first discharge-side intermediate branch tube 83 constituting the intermediate refrigerant tube 8, and the refrigerant is further compressed and then discharged to the first discharge branch tube 203*b*. The compressor 30 is configured so that refrigerant is drawn in through the second intake branch tube 204*a*, the drawn-in refrigerant is compressed by the compression element 204*c* and then discharged to a second inlet-side intermediate branch tube 84 constituting the intermediate refrigerant tube 8, the refrigerant discharged to the second inlet-side intermediate branch tube 84 is drawn in into the compression element 204*d* via the intermediate header tube 82 and a second outlet-side intermediate branch tube 85 constituting the intermediate refrigerant tube 8, and the refrigerant is further compressed and then discharged to the second discharge branch tube 204*b*. In the present modification, the intermediate refrigerant tube 8 is a refrigerant tube for admitting refrigerant discharged from the compression elements 203*c*, 204*c* connected to the first-stage sides of the compression elements 203*d*, 204*d* into the compression elements 203*d*, 204*d* connected to the second-stage sides of the compression elements 203*c*, 204*c*, and the intermediate refrigerant tube 8 primarily comprises the first inlet-side intermediate branch tube 81 connected to the discharge side of the first-stage compression element 203*c* of the first compression mechanism 203, the second inlet-side intermediate branch tube 84 connected to the discharge side of the first-stage compression element 204*c* of the second compression mechanism 204, the intermediate header tube 82 whose flow merges with both inlet-side intermediate branch tubes 81, 84, the first discharge-side intermediate branch tube 83 branching off from the intermediate header tube 82 and connected to the intake side of the second-stage compression element 203*d* of the first compression mechanism 203, and the second outlet-side intermediate branch tube 85 branching off from the intermediate header tube 82 and connected to the intake side of the second-stage compression element 204*d* of the second compression mechanism 204. The discharge header tube 202*b* is a refrigerant tube for feeding the refrigerant discharged from the compression mechanism 202 to the switching mechanism 3, and the first discharge branch tube 203*b* connected to the discharge header tube 202*b* is provided with a first oil separation mechanism 241 and a first non-return mechanism 242, while the second discharge branch tube 204*b* connected to the discharge header tube 202*b* is provided with a second oil separation mechanism 243 and a second non-return mechanism 244. The first oil separation mechanism 241 is a mechanism for separating from the refrigerant the refrigeration oil accompanying the refrigerant discharged from the first compression mechanism 203 and returning the oil to the intake side of the compression mechanism 202. The first oil separation mechanism 241 primarily comprises a first oil separator 241*a* for separating from the refrigerant the refrigeration oil accompanying the refrigerant discharged from the first compression mechanism 203, and a first oil return tube 241*b* connected to the first oil separator 241*a* for returning the refrigeration oil separated from the refrigerant to the intake side of the compression mechanism 202. The second oil separation mechanism 243 is a mechanism for separating from the refrigerant the refrigeration oil accompanying the refrigerant discharged from the second compression mechanism 204 and returning the oil to the intake side of the compression mechanism 202. The second oil separation mechanism 243 primarily comprises a second oil separator 243*a* for separating from the refrigerant the refrigeration oil accompanying the refrigerant discharged from the second compression mechanism 204, and a second oil return tube 243*b* connected to the second oil separator 243*a* for returning the refrigeration oil separated from the refrigerant to the intake side of the compression mechanism 202. In the present modification, the first oil return tube 241*b* is connected to the second intake branch tube 204*a*, and the second oil return tube 243*b* is connected to the first intake branch tube 203*a*. Therefore, even if there is a disparity between the amount of refrigeration oil accompanying the refrigerant discharged from the first compression mechanism 203 and the amount of refrigeration oil accompanying the refrigerant discharged from the second compression mechanism 204, which occurs as a result of a disparity between the amount of refrigeration oil retained in the first compression mechanism 203 and the amount of refrigeration oil retained in the second compression mechanism 204, more refrigeration oil returns to whichever of the compression mechanisms 203, 204 has the smaller amount of refrigeration oil, thus resolving the disparity between the amount of refrigeration oil retained in the first compression mechanism 203 and the amount of refrigeration oil retained in the second compression mechanism 204. In the present modification, the first intake branch tube 203*a* is configured so that the portion leading from the flow juncture with the second oil return tube 243*b* to the flow juncture with the intake header tube 202*a* slopes downward toward the flow juncture with the intake header tube 202*a*, while the second intake branch tube 204*a* is configured so that the portion leading from the flow juncture with the first oil return tube 241*b* to the flow juncture with the intake header tube 202*a* slopes downward toward the flow juncture with the intake header tube 202*a*. Therefore, even if either one of the two-stage compression-type compression mechanisms 203, 204 is stopped, refrigeration oil being returned from the oil return tube corresponding to the operating compression mechanism to the intake branch tube corresponding to the stopped compression mechanism is returned to the intake header tube 202*a*, and there will be little likelihood of a shortage of oil supplied to the operating compression mechanism. The oil return tubes 241*b*, 243*b* are provided with depressurizing mechanisms 241*c*, 243*c* for depressurizing the refrigeration oil flowing through the oil return tubes 241*b*, 243*b*. The non-return mechanisms 242, 244 are mechanisms for allowing refrigerant to flow from the discharge sides of the compression mechanisms 203, 204 to the switching mechanism 3 and for blocking the flow of refrigerant from the switching mechanism 3 to the discharge sides of the compression mechanisms 203, 204.

Thus, in the present modification, the compression mechanism 202 is configured by connecting two compression mechanisms in parallel; namely, the first compression mechanism 203 having two compression elements 203*c*, 203*d* and configured so that refrigerant discharged from the first-stage compression element of these compression elements 203*c*, 203*d* is sequentially compressed by the second-stage compression element, and the second compression mechanism 204 having two compression elements 204*c*, 204*d* and configured so that refrigerant discharged from the first-stage compression element of these compression elements 204*c*, 204*d* is sequentially compressed by the second-stage compression element.

The first inlet-side intermediate branch tube 81 constituting the intermediate refrigerant tube 8 is provided with a non-return mechanism 81*a* for allowing the flow of refrigerant from the discharge side of the first-stage compression element 203*c* of the first compression, mechanism 203 toward the intermediate header tube 82 and for blocking the flow of refrigerant from the intermediate header tube 82 toward the discharge side of the first-stage compression element 203*c*, while the second inlet-side intermediate branch tube 84 constituting the intermediate refrigerant tube 8 is provided with a non-return mechanism 84*a* for allowing the flow of refrigerant from the discharge side of the first-stage compression element 204*c* of the second compression mechanism 204 toward the intermediate header tube 82 and for blocking the flow of refrigerant from the intermediate header tube 82 toward the discharge side of the first-stage compression element 204*c*. In the present modification, non-return valves are used as the non-return mechanisms 81*a*, 84*a*. Therefore, even if either one of the compression mechanisms 203, 204 has stopped, there are no instances in which refrigerant discharged from the first-stage compression element of the operating compression mechanism passes through the intermediate refrigerant tube 8 and travels to the discharge side of the first-stage compression element of the stopped compression mechanism. Therefore, there are no instances in which refrigerant discharged from the first-stage compression element of the operating compression mechanism passes through the interior of the first-stage compression element of the stopped compression mechanism and exits out through the intake side of the compression mechanism 202, which would cause the refrigeration oil of the stopped compression mechanism to flow out, and it is thus unlikely that there will be insufficient refrigeration oil for starting up the stopped compression mechanism. In the case that the compression mechanisms 203, 204 are operated in order of priority (for example, in the case of a compression mechanism in which priority is given to operating the first compression mechanism 203), the stopped compression mechanism described above will always be the second compression mechanism 204, and therefore in this case only the non-return mechanism 84*a* corresponding to the second compression mechanism 204 need be provided.

In cases of a compression mechanism which prioritizes operating the first compression mechanism 203 as described above, since a shared intermediate refrigerant tube 8 is provided for both compression mechanisms 203, 204, the refrigerant discharged from the first-stage compression element 203*c* corresponding to the operating first compression mechanism 203 passes through the second outlet-side intermediate branch tube 85 of the intermediate refrigerant tube 8 and travels to the intake side of the second-stage compression element 204*d* of the stopped second compression mechanism 204, whereby there is a danger that refrigerant discharged from the first-stage compression element 203*c* of the operating first compression mechanism 203 will pass through the interior of the second-stage compression element 204*d* of the stopped second compression mechanism 204 and exit out through the discharge side of the compression mechanism 202, causing the refrigeration oil of the stopped second compression mechanism 204 to flow out, resulting in insufficient refrigeration oil for starting up the stopped second compression mechanism 204. In view of this, an on/off valve 85*a* is provided to the second outlet-side intermediate branch tube 85 in the present modification, and when the second compression mechanism 204 has stopped, the flow of refrigerant through the second outlet-side intermediate branch tube 85 is blocked by the on/off valve 85*a*. The refrigerant discharged from the first-stage compression element 203*c* of the operating first compression mechanism 203 thereby no longer passes through the second outlet-side intermediate branch tube 85 of the intermediate refrigerant tube 8 and travels to the intake side of the second-stage compression element 204*d* of the stopped second compression mechanism 204; therefore, there are no longer any instances in which the refrigerant discharged from the first-stage compression element 203*c* of the operating first compression mechanism 203 passes through the interior of the second-stage compression element 204*d* of the stopped second compression mechanism 204 and exits out through the discharge side of the compression mechanism 202 which causes the refrigeration oil of the stopped second compression mechanism 204 to flow out, and it is thereby even more unlikely that there will be insufficient refrigeration oil for starting up the stopped second compression mechanism 204. An electromagnetic valve is used as the on/off valve 85*a* in the present modification.

In the case of a compression mechanism which prioritizes operating the first compression mechanism 203, the second compression mechanism 204 is started up in continuation from the starting up of the first compression mechanism 203, but at this time, since a shared intermediate refrigerant tube 8 is provided for both compression mechanisms 203, 204, the starting up takes place from a state in which the pressure in the discharge side of the first-stage compression element 203*c* of the second compression mechanism 204 and the pressure in the intake side of the second-stage compression element 203*d* are greater than the pressure in the intake side of the first-stage compression element 203*c* and the pressure in the discharge side of the second-stage compression element 203*d*, and it is difficult to start up the second compression mechanism 204 in a stable manner. In view of this, in the present modification, there is provided a startup bypass tube 86 for connecting the discharge side of the first-stage compression element 204*c* of the second compression mechanism 204 and the intake side of the second-stage compression element 204*d*, and an on/off valve 86*a* is provided to this startup bypass tube 86. In cases in which the second compression mechanism 204 has stopped, the flow of refrigerant through the startup bypass tube 86 is blocked by the on/off valve 86*a* and the flow of refrigerant through the second outlet-side intermediate branch tube 85 is blocked by the on/off valve 85*a*. When the second compression mechanism 204 is started up, a state in which refrigerant is allowed to flow through the startup bypass tube 86 can be restored via the on/off valve 86*a*, whereby the refrigerant discharged from the first-stage compression element 204*c* of the second compression mechanism 204 is drawn into the second-stage compression element 204*d* via the startup bypass tube 86 without being mixed with the refrigerant discharged from the first-stage compression element 203*c* of the first compression mechanism 203, a state of allowing refrigerant to flow through the second outlet-side intermediate branch tube 85 can be restored via the on/off valve 85*a* at point in time when the operating state of the compression mechanism 202 has been stabilized (e.g., a point in time when the intake pressure, discharge pressure, and intermediate pressure of the compression mechanism 202 have been stabilized), the flow of refrigerant through the startup bypass tube 86 can be blocked by the on/off valve 86*a*, and operation can transition to the normal air-cooling operation. In the present modification, one end of the startup bypass tube 86 is connected between the on/off valve 85*a* of the second outlet-side intermediate branch tube 85 and the intake side of the second-stage compression element 204*d* of the second compression mechanism 204, while the other end is connected between the discharge side of the first-stage compression element 204*c* of the second compression mechanism 204 and the non-return mechanism 84*a* of the second inlet-side intermediate branch tube 84, and when the second compression mechanism 204 is started up, the startup bypass tube 86 can be kept in a state of being substantially unaffected by the intermediate pressure portion of the first compression mechanism 203. An electromagnetic valve is used as the on/off valve 86*a* in the present modification.

The actions of the air-conditioning apparatus 1 of the present modification during the air-cooling operation, the air-warming operation, and the defrosting operation are essentially the same as the actions in the above-described embodiment and modifications thereof (FIGS. 1 through 17 and the relevant descriptions), except that the points modified by the circuit configuration surrounding the compression mechanism 202 are somewhat more complex due to the compression mechanism 202 being provided instead of the compression mechanism 2, for which reason the actions are not described herein.

The same operational effects of the above-described embodiment and modifications thereof can be achieved with the configuration of Modification 4.

Though not described in detail herein, a compression mechanism having more stages than a two-stage compression system, such as a three-stage compression system or the like, may be used instead of the two-stage compression-type compression mechanism 2 or the two-stage compression-type compression mechanisms 203, 204, or a parallel multi-stage compression-type compression mechanism may be used in which three or more multi-stage compression-type compression mechanisms are connected in parallel, and the same effects as those of the present modification can be achieved in this case as well. In the air-conditioning apparatus 1 of the present modification, the use of a bridge circuit 17 is included from the standpoint of keeping the direction of refrigerant flow constant in the receiver inlet expansion mechanism 5*a*, the receiver outlet expansion mechanism 5*b*, the receiver 18, the second-stage injection tube 19, or the economizer heat exchanger 20, regardless of whether the air-cooling operation or air-warming operation is in effect. However, the bridge circuit 17 may be omitted in cases in which there is no need to keep the direction of refrigerant flow constant in the receiver inlet expansion mechanism 5*a*, the receiver outlet expansion mechanism 5*b*, the receiver 18, the second-stage injection tube 19, or the economizer heat exchanger 20 regardless of whether the air-cooling operation of the air-warming operation is taking place, such as cases in which the second-stage injection tube 19 and economizer heat exchanger 20 are used either during the air-cooling operation alone or during the air-warming operation alone, for example.

(7) Modification 5

The refrigerant circuit 310 (see FIGS. 9 and 18) and the refrigerant circuit 410 (see FIG. 19) in the modification described above have configurations in which one usage-side heat exchanger 6 is connected, but alternatively may have configurations in which a plurality of usage-side heat exchangers 6 is connected and these usage-side heat exchangers 6 can be started and stopped individually.

Figure 20:
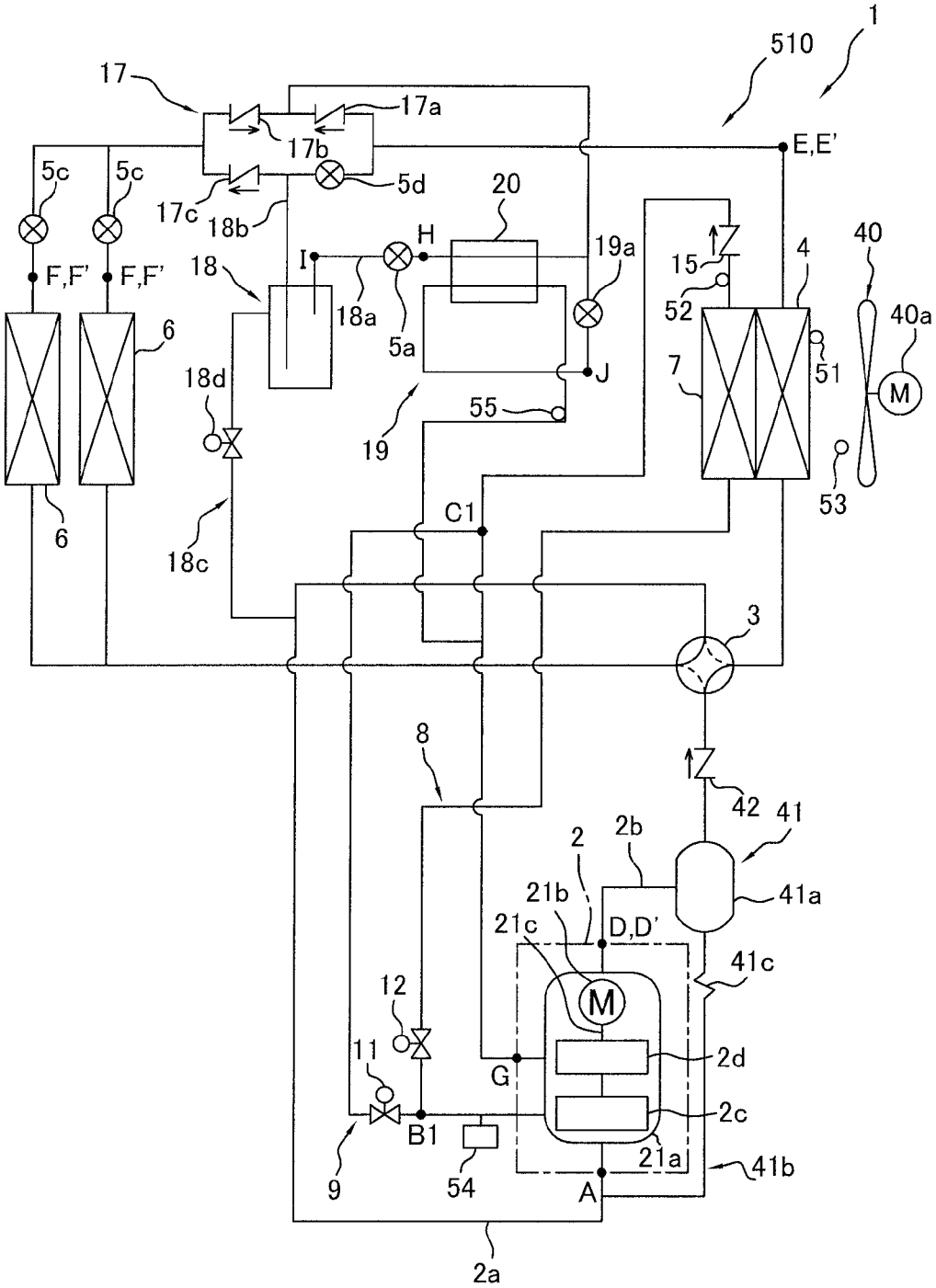
FIG. 20 is a schematic structural diagram of an air-conditioning apparatus according to Modification 5.
Figure 21:
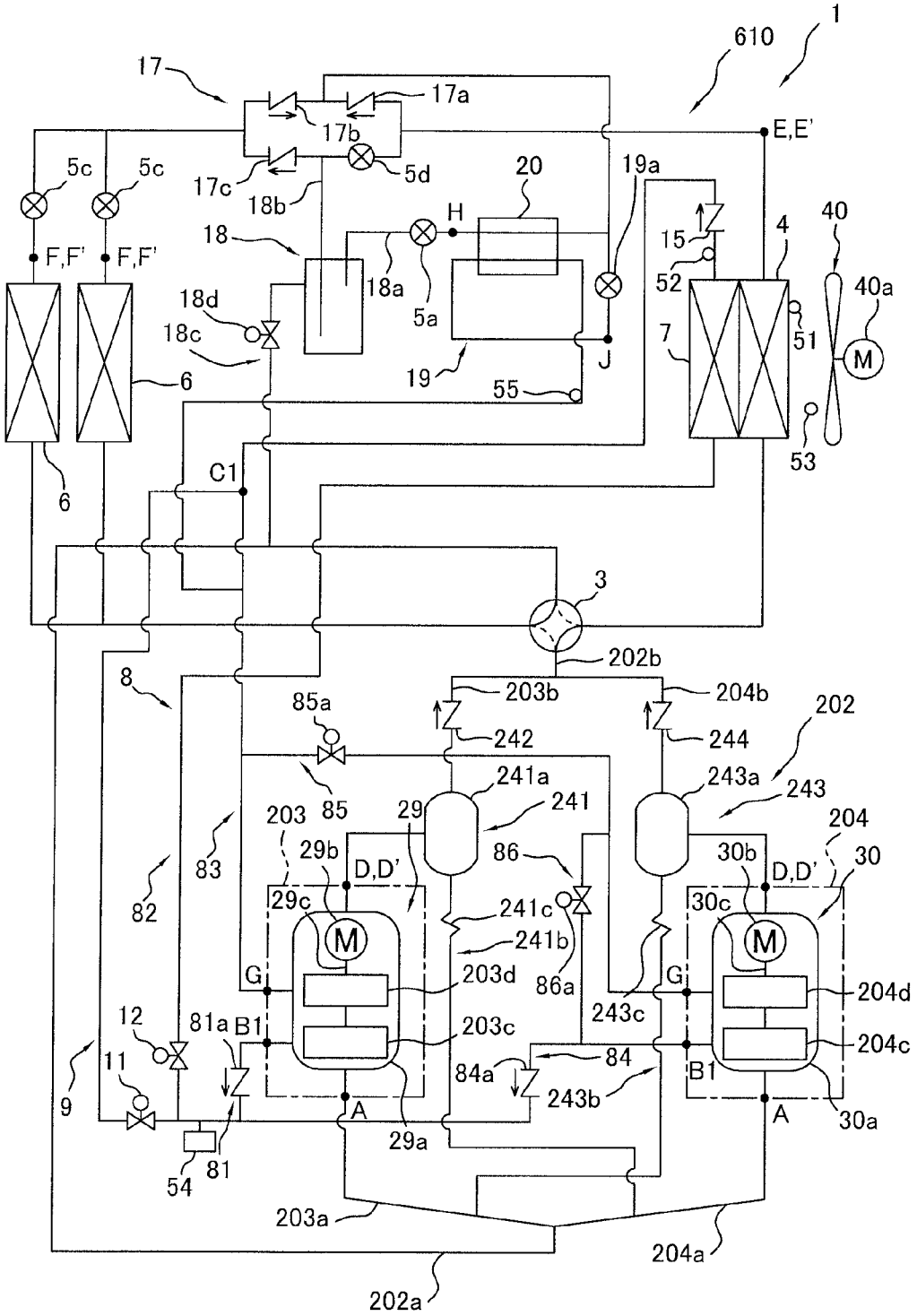
FIG. 21 is a schematic structural diagram of an air-conditioning apparatus according to Modification 5.

For example, the refrigerant circuit 310 (FIG. 9) which uses a two-stage compression-type compression mechanism 2 may be fashioned into a refrigerant circuit 510 in which two usage-side heat exchangers 6 are connected, usage-side expansion mechanisms 5*c* are provided corresponding to the ends of the usage-side heat exchangers 6 on the sides facing the bridge circuit 17, the receiver outlet expansion mechanism 5*b* previously provided to the receiver outlet tube 18*b* is omitted, and a bridge outlet expansion mechanism 5*d* is provided instead of the outlet non-return valve 17*d* of the bridge circuit 17, as shown in FIG. 20. Alternatively, the refrigerant circuit 410 (see FIG. 19) which uses a parallel two-stage compression-type compression mechanism 202 may be fashioned into a refrigerant circuit 610 in which two usage-side heat exchangers 6 are connected, usage-side expansion mechanisms 5*c* are provided corresponding to the ends of the usage-side heat exchangers 6 on the sides facing the bridge circuit 17, the receiver outlet expansion mechanism 5*b* previously provided to the receiver outlet tube 18*b* is omitted, and a bridge outlet expansion mechanism 5*d* is provided instead of the outlet non-return valve 17*d* of the bridge circuit 17, as shown in FIG. 21.

The configuration of the present modification has different actions during the air-cooling operations and defrosting operations of the previous modifications in that during the air-cooling operation, the bridge outlet expansion mechanism 5*d* is fully closed, and in place of the receiver outlet expansion mechanism 5*b* in the previous modifications, the usage-side expansion mechanisms 5*c* perform the action of further depressurizing the refrigerant already depressurized by the receiver inlet expansion mechanism 5*a* to a lower pressure before the refrigerant is fed to the usage-side heat exchangers 6; but the other actions of the present modification are essentially the same as the actions during the air-cooling operations and defrosting operations of the previous modifications (FIGS. 6, 9 through 11, and 14 through 17, as well as their relevant descriptions). The present modification also has actions different from those during the air-warming operations of the previous modifications in that during the air-warming operation, the opening degrees of the usage-side expansion mechanisms 5*c* are adjusted so as to control the flow rate of refrigerant flowing through the usage-side heat exchangers 6, and in place of the receiver outlet expansion mechanism 5*b* in the previous modifications, the bridge outlet expansion mechanism 5*d* performs the action of further depressurizing the refrigerant already depressurized by the receiver inlet expansion mechanism 5*a* to a lower pressure before the refrigerant is fed to the heat source-side heat exchanger 4; however, the other actions of the present modification are essentially the same as the actions during the air-warming operations of the previous modifications (FIGS. 9, 12 and 13, and their relevant descriptions).

The same operational effects as those of the previous modifications can also be achieved with the configuration of the present modification.

Though not described in detail herein, a compression mechanism having more stages than a two-stage compression system, such as a three-stage compression system or the like, may be used instead of the two-stage compression-type compression mechanisms 2, 203, and 204.

(8) Other Embodiments

Embodiments of the present invention and modifications thereof are described above with reference to the drawings, but the specific configuration is not limited to these embodiments or their modifications, and can be changed within a range that does not deviate from the scope of the invention.

For example, in the above-described embodiment and modifications thereof, the present invention may be applied to a so-called chiller-type air-conditioning apparatus in which water or brine is used as a heating source or cooling source for conducting heat exchange with the refrigerant flowing through the usage-side heat exchanger 6, and a secondary heat exchanger is provided for conducting heat exchange between indoor air and the water or brine that has undergone heat exchange in the usage-side heat exchanger 6.

The present invention can also be applied to other types of refrigeration apparatuses besides the above-described chiller-type air-conditioning apparatus, as long as the apparatus has a refrigerant circuit configured to be capable of switching between a cooling operation and a heating operation, and the apparatus performs a multistage compression refrigeration cycle by using a refrigerant that operates in a supercritical range as its refrigerant.

The refrigerant that operates in a supercritical range is not limited to carbon dioxide; ethylene, ethane, nitric oxide, and other gases may also be used.

Industrial Applicability

If the present invention is used, then when a defrosting operation is performed in a refrigeration apparatus which has a refrigerant circuit configured to be capable of switching between a cooling operation and a heating operation and which performs a multistage compression refrigeration cycle using a refrigerant that operates in a supercritical range, it is possible to minimize loss of defrosting capacity resulting from heat being radiated from the intercooler to the exterior.

What is claimed is:

1. A refrigeration apparatus using a refrigerant operating in a supercritical range, the refrigeration apparatus comprising:

a compression mechanism having a plurality of compression elements including a first-stage compression element and a second-stage compression element, the compression mechanism being configured and arranged to sequentially compress refrigerant in the first-stage compression element and then in the second-stage compression element;

a heat source-side heat exchanger with air being used as a heat source to cool or heat the refrigerant;

an expansion mechanism configured and arranged to depressurize the refrigerant;

a usage-side heat exchanger configured and arranged to function as a heater or cooler of refrigerant;

a switching mechanism configured and arranged to switch between a cooling operation state sequentially circulating the refrigerant through the compression mechanism, the heat source-side heat exchanger, the expansion mechanism, and the usage-side heat exchanger, and a heating operation state sequentially circulating the refrigerant through the compression mechanism, the usage-side heat exchanger, the expansion mechanism, and the heat source-side heat exchanger;

an intercooler integrated with the heat source-side heat exchanger and having air as a heat source, the intercooler being configured and arranged to cool refrigerant flowing through an intermediate refrigerant tube, the intermediate refrigerant tube drawing refrigerant discharged from the first-stage compression element into the second-stage compression element; and an intercooler bypass tube connected to the intermediate refrigerant tube and arranged to bypass the intercooler, the refrigerant being caused to flow to the heat source-side heat exchanger and the intercooler upon the heat source-side heat exchanger being caused to function as a cooler of refrigerant and a defrosting operation for defrosting the heat source-side heat exchanger being performed, and the intercooler bypass tube ensuring the refrigerant does not flow to the intercooler upon the heat source-side heat exchanger being caused to function as a cooler of refrigerant and after defrosting of the intercooler is detected as being complete.

2. The refrigeration apparatus according to claim 1, wherein completion of the defrosting of the intercooler is detected based on temperature f the refrigerant in an outlet of the intercooler.

3. The refrigeration apparatus according to claim 1, wherein the refrigerant operating in the supercritical range is carbon dioxide.

4. The refrigeration apparatus according to claim 2, wherein the refrigerant operating in the supercritical range is carbon dioxide.

* * * * *